US007059741B2

(12) United States Patent
Elsener

(10) Patent No.: US 7,059,741 B2
(45) Date of Patent: Jun. 13, 2006

(54) POCKET TOOL

(75) Inventor: Karl Elsener, Ibach (CH)

(73) Assignee: Victorinox AG, Ibach-Schwyz (CH)

( * ) Notice: Subject to any disclaimer, the term of this patent is extended or adjusted under 35 U.S.C. 154(b) by 0 days.

(21) Appl. No.: 10/699,112

(22) Filed: Oct. 30, 2003

(65) Prior Publication Data

US 2004/0141313 A1 Jul. 22, 2004

(30) Foreign Application Priority Data

Oct. 30, 2002 (AT) ..... A 1644/2002
Aug. 27, 2003 (AT) ..... A 1342/2003

(51) Int. Cl.
*B25B 23/18* (2006.01)

(52) U.S. Cl. ..... 362/119; 362/109; 362/295

(58) Field of Classification Search ..... 362/119, 362/120, 253, 190, 296; 7/119, 118
See application file for complete search history.

(56) References Cited

U.S. PATENT DOCUMENTS 5,313,376 A * 5/1994 McIntosh ..... 362/119
5,626,414 A * 5/1997 Chen ..... 362/119
5,653,525 A * 8/1997 Park ..... 362/119
5,916,277 A 6/1999 Dallas
5,967,641 A 10/1999 Sung et al.
6,142,769 A * 11/2000 Walker ..... 431/253
6,341,423 B1 1/2002 Taggart et al.
2004/0016058 A1* 1/2004 Gardiner et al. ..... 7/119

* cited by examiner

*Primary Examiner*—Ali Alavi
(74) *Attorney, Agent, or Firm*—Fross Zelnick Lehrman & Zissu, P.C.; Philip T. Shannon, Esq.

(57) ABSTRACT

A pocket tool with a housing body with two oppositely lying side faces bounding at least certain regions thereof, and at least one housing area between the side faces, and an implement displaceable out of a stowed position inside the housing area and an operating position outside the housing area. The displaceable implement has a housing case with two oppositely lying side walls extending substantially parallel to and spaced apart from the side faces, and slim faces extending between the side walls, and at least one electrical lighting means provided on the housing case. The lighting means is provided on a side-end first slim face of the housing case remote from the housing body. An axis of symmetry of a beam emitted by the lighting means and a plane oriented perpendicular to the longitudinal axis of the pocket tool subtend an angle which is freely adjustable. The invention further relates to a switch connecting mechanism for a switch contact in an implement of the pocket tool.

53 Claims, 19 Drawing Sheets

POCKET TOOL

FIELD OF THE INVENTION

The present invention relates to a pocket tool, such as a pocket knife or plate-shaped tool card, having housing area therein and a first implement which can be displaced from a stowed position inside the housing area into an operating position outside the housing area.

BACKGROUND OF THE INVENTION

Various pocket tools with implements that can be removed or pivoted out of a stowed position within a housing area within the tool and into an operating position are known in the art. For example, DE 299 04 917 U1 discloses a pocket tool which has a housing body bounded by two oppositely lying side faces with at least one housing area between the side faces, and at least one implement which can be pivoted out of a stowed position inside the housing area into an operating position outside the housing area. This implement is mounted so as to pivot about an axis extending perpendicular to the side faces and incorporates a housing case with two mutually opposed, spaced apart side walls extending parallel to the side faces and a slim face extending between the side walls. The housing case has a compartment for a UV-LED and a housing compartment for a battery which can be pivoted about an axis extending perpendicular to the side walls. The UV-LED is disposed in the region of one of the side walls of the housing case and an axis of symmetry of a conical light beam extends more or less at a right angle to the longitudinal axis of the pocket tool and parallel to the axis of the implement. A side wall is provided with an operating element for operating the UV-LED. In order to operate the UV-LED, the implement must firstly be pivoted out of its stowed position into the operating position in order to gain free access to the operating element of the UV-LED. The UV light can be used to check value markings and security features on bank notes, credit cards or identity cards. The pocket tool also has a knife blade and a pair of scissors, which can also be pivoted out of a stowed position inside another housing area into an operating position outside of the other housing area. The fact that the UV-LED is disposed parallel to the axis of the implement means that the housing case and hence the pocket tool has to be made wider, which is undesirable and means that only a small number of implements can be provided on the pocket tool for a comparatively slim width of the pocket tool.

A pocket tool with a plurality of different implements is also known from United States PCT Application No. PCT/US99/10511, and related publication WO 99/58303 A1, and has a housing body bounded by two mutually opposite side walls with several housing areas between the side faces as well as a plurality of implements which can be pivoted out from a stowed position inside the respective housing area into an operating position outside the respective housing area. One of these implements is mounted on the first slim face of the pocket tool so that it can be pivoted about an axis extending perpendicular to the side faces and is provided with a housing case with two mutually opposite side walls and slim faces extending between the side walls. Provided in the side wall of the housing case remote from the housing body are an electronic display, in particular a LCD display, and operating buttons. The electronic display is supplied with voltage from a battery disposed inside this housing case. Other implements may be provided on the oppositely lying second slim face and can also be pivoted about an axis extending perpendicular to the side faces Such implements include a knife blade, nail file, pair of scissors, etc. In one of its end regions, the pocket tool also has a lighting means opposite the housing area which is permanently fixed in the housing area, in particular an LED, which can be switched on by means of an operating element arranged on the side face of the housing body.

U.S. Pat. No. 6,347,875, and related publication WO 99/07247 A, disclose a pocket tool in the form of a pocket knife, which has one or more implements, such as knife blades, cork screw, screwdriver, and the like, which are arranged between two mutually opposed cover plates and can be pivoted out of a stowed position within the housing body into an operating position outside the housing body. These implements are usually mounted so that they pivot against the action of a spring and are retained in the retracted or extracted stowed or operating positions by means of the spring force. The functionality of this known pocket tool was enhanced by providing a lighting system in the housing body. As an integral element, the lighting system is arranged in the pocket tool, which is a disadvantage in terms of accessibility during replacement when a battery or a light source has to be changed, and special tools are needed for this purpose which the user of the pocket tool does not necessarily have to hand.

Another embodiment of a pocket tool is known from publication WO 01/39629 A, and in particular a tool card, which has several housing areas for implements inside it between a base plate and a cover plate, which are accessible from the outside via housing openings. The base plate and cover plate as well as the handles of the implements are made from a transparent, in particular see-through, plastic and a lighting system is provided inside the tool card between the base plate and top plate. The lighting system consists of a lighting means, a battery, and an operating element, by means of which the lighting means can be operated as and when necessary. It has been found to be advantageous to use a transparent plastic for the base plate and cover plate to enable a housing area inside the tool card-case to be illuminated. However, the disadvantage of this pocket tool known from the prior art is that a working area external to the pocket tool can not be satisfactorily illuminated, which severely restricts the applications for which it can be used.

SUMMARY OF THE INVENTION

The present invention provides a pocket tool with a displaceable implement incorporating a power consumer made to the smallest possible dimensions. The pocket tool of the present invention can fulfill several additional functions, facilitates handling, and is distinctive due to its compact design. Furthermore, a switch connecting mechanism for a switch contact is provided in an implement of a pocket tool, by means of which a power consumer, such as a lighting means, can be operated in a particularly simple manner, so that the implement can be made to a compact size.

In accordance with the principles of the present invention, at least one lighting means is provided on the side face of a first slim face of the housing case remote from the housing body and an axis of symmetry of a beam (e.g., a conical beam) emitted by the lighting means and a plane disposed perpendicular to the longitudinal axis of the pocket tool subtend a preferably adjustable angle. The lighting means and the operating button may be arranged on the slim face of the housing case and the operating button may be linked to a strip-shaped retaining arm which can be displaced between a non-operating position and an operating position. The retaining arm may be provided with two spaced apart guide webs on one of its side faces, between which a terminal wire of the lighting means is disposed so that it can be guided. When the retaining arm is in the non-operating position, the terminal wire of the lighting means is at a distance from the mating contact, and when the retaining arm is in the operating position it lies against and is electrically connected to the mating contact.

The advantage of this is that once the implement has been moved into its operating position outside of the housing body, the at least one lighting means and, if necessary, the at least one energy storage device can be accessed without being hampered by the spatially limited dimensions of the housing body of the pocket tool, on the one hand, and a desired working surface can be optimally lighted due to the freely adjustable angle, on the other. For the first of these situations, the detachable first housing part must be removed from the second housing part, to enable the at least one lighting means and/or the energy storage device to be replaced, after which the first housing part can then be secured to the second housing part. A desired working surface can be optimally illuminated because the implement carrying the at least one lighting means merely has to be displaced from its stowed position inside the housing area into the operating position outside the housing area and not the pocket tool itself. Consequently, an axis of symmetry of a beam (such as a conical beam) and a plane disposed perpendicular to the longitudinal axis of the pocket tool can subtend virtually any angle, which can be adjusted essentially irrespective of the position of the pocket tool. This also means that the beam can be projected onto those points of the working surface where particularly dense lighting is required. The at least one lighting means is disposed on a side-end first slim face of the housing case remote from the housing body in a plane between the side walls extending substantially parallel to the side walls. Consequently, a width as measured between the side walls of the housing case can be optimized so that the implement may be of a slim design. The pocket tool can therefore be made to the smallest possible yet ergonomic-to-handle external dimensions while being equipped with a large number of implements.

In another embodiment of the invention, the angle subtended by the axis of symmetry of the beam and the plane perpendicular to the longitudinal axis of the pocket tool may be freely adjusted between approximately 0° and approximately 170°.

The lighting means is supplied with power by means of at least one energy storage device, which is expediently arranged inside the housing case of the implement, enclosed on all sides.

Another advantageous embodiment of the pocket tool is one in which, in addition to the lighting means, the first implement incorporates at least one power consumer, which preferably sits inside the housing case enclosed on all sides and/or in its freely accessible side wall and/or in the side-end first or freely accessible other slim face. This power consumer may be designed accordingly for different applications, which enhances the practical value of the individual implement.

It is also advantageous to provide an electronic circuit for the lighting means inside the housing case and enclosed on all sides. The lighting means is supplied with the requisite voltage by means of the electronic circuit. This electronic circuit is provided with appropriate electronic components, which may be disposed on a board or alternatively a film or optionally may be housed in a single electronic component. The electronic circuit may also be provided with at least one energy storage device if necessary and/or at least one power consumer. Operating safety is high because the electronic circuit is arranged inside the housing case protected from external influences.

In another embodiment of the invention, the implement is additionally provided with the switch mechanism for the lighting means, enabling the implement to fulfill all the tasks required of it.

The operating element of the switch mechanism is expediently provided on the other slim face of the housing case which is freely accessible to the user. The lighting means is switched on and off by means of the operating element. This operating element is arranged in such a way that it cannot be inadvertently operated. To this end, a matching recess is provided in the other slim face of the housing case, from the base of which the operating element, in particular an operating button, projects. Consequently, the lighting means is prevented from being inadvertently switched on if the work tool is placed in a trouser pocket.

In another embodiment of the switch mechanism, the operating element is linked to a strip-shaped retaining arm, which can be moved between an initial position and an operating position. The retaining arm is provided with two guide webs spaced apart from each other, between which a switch contact is guided, being coupled with the retaining arm in displacement. When the retaining arm is in the initial position, the switch contact is at a distance from the mating contact, in particular an energy storage device, whereas when the retaining arm is in the operating position, it sits against the mating contact and is electrically connected to the mating contact. Consequently, the retaining arm advantageously at the same time acts as a guide for at least one switch contact, preferably for the lighting means, and the switch circuit can be opened and closed as the retaining arm is displaced, for example between the lighting means and an energy storage device.

The retaining arm is guided on the switch and guide block in the direction perpendicular to the bearing surface in a simple and accurate way, due to the fact that the retaining arm is longitudinally slideable by means of a bearing surface in the region of the first terminal end on a switch block extending parallel to its longitudinal direction and is seated on the bearing surface so that it can pivot, and in the region of a bearing surface at the second side end is guided in its longitudinal direction on a guide block.

In a first embodiment, the pocket tool is a pocket knife and the housing case is pivotable between the side walls about an axis extending perpendicular to the side faces or is mounted on or in the housing body so as to be slidable relative to the first housing area in the direction of its longitudinal extension. This makes for a compact pocket tool of simple structure, made from only a few individual parts.

In another embodiment, the electronic circuit for the lighting means and/or at least one energy storage device and/or at least one power consumer and/or the switch mechanism is integrated in the housing body separately from the first implement and externally to it or in or on the cover plate attached to the side wall or in the side wall. This enables the size of the implement incorporating the lighting means to be reduced considerably, so that better use can be made of the space which is provided inside the housing body anyway or the side wall or cover plate in particular. Appropriate wire connections are provided for this purpose between the lighting means and the electronic circuit and/or the energy storage device and/or the power consumer and/or the switch mechanism.

In a second embodiment, the pocket tool is provided in the form of a tool card. The implements are arranged adjacent to one another in a same plane, as a result of which the tool card-case can be designed with relatively small dimensions, even if a large number of implements are housed in the tool card. The external dimensions preferably correspond more or less to the dimensions of a credit card or bank card. By providing housing openings in the housing areas, the implements are readily accessible, making it easy to take the implements out. The preferably rib-type thin webs between the base plate and cover plate form a plurality of ribs, giving the plate-shaped tool card a very stable structure, even though the base plate and cover plate as well as the webs have extremely thin wall thicknesses. Furthermore, being made out of plastic, the base plate and cover plate are very easy to manufacture using an injection molding process and the webs can be made with a slim thickness.

Also advantageous is a housing case embodiment designed in the shape of a segment of a circle or half-circle. In this embodiment, the lighting means is arranged on the side-end first slim face remote from the housing body and offset from the corner region or center point in a radial direction. Due to the fact that the lighting means is arranged externally to the housing body and as a result of the eccentric position of the lighting means relative to the axis about which the implement is mounted on the housing case, the angle of incidence of the beam can be freely adjusted so that it can be directed onto a work surface to be illuminated.

In another embodiment, the electronic circuit for the lighting means and/or the at least one energy storage device and/or the at least one power consumer and/or the switch mechanism is integrated in the housing body separately from the first implement and externally to it or in the base plate and/or cover plate, and is electrically connected to the lighting means by wire connections and/or switch contacts. This enables the size of the implement incorporating the lighting means to be reduced considerably and makes better use of space that is provided inside the housing body anyway.

In another embodiment of the invention, the housing body is provided with a control block projecting out from the internal contour of the housing case and the implement incorporating the energy storage device and the lighting means which can be displaced between a stowed position and an operating position has an adjusting element which can be moved between an initial position and an operating position by means of the control block. The adjusting element may be provided in the form of an electrically conductive switch contact or flexible arm. In the former case, the switch contact is electrically connected to a first terminal contact of the lighting means. In its initial position, the switch contact is electrically isolated from a first terminal face of the energy storage device and in its operating position is in electrical contact with the first terminal face of the energy storage device. The second terminal contact of the lighting means is permanently in electrical contact with a second terminal face of the energy storage device. In the second situation, the flexible arm, which for practical purposes is electrically isolated, is coupled with the first terminal contact of the lighting means in displacement. The advantage of this is that the electric switch circuit is opened and closed merely by displacing the implement and housing case between the stowed position and the operating position, obviating the need to switch the light means on and off. This means that the operating element can be dispensed with.

It is of particular advantage to be able to lock the implement in its stowed position and operating position, to prevent any undesirable shifting.

By providing a pivotable seating on the implement for the lighting means, the angle can be adjusted over a bigger range and the conical beam can be directed in both directions in a symmetrical arrangement relative to the longitudinal axis of the pocket tool.

Also of advantage is the two-part design of the housing case. A dividing plane is formed between the housing parts so that the at least one energy storage device and at least one implement incorporating at least one power consumer can be rapidly moved into its extracted position if operation of the lighting means fails or the empty energy storage device has to be changed rapidly.

In another embodiment, the housing compartments for the energy storage device and the compartment for the lighting means and/or the power consumer are arranged in a plane parallel to the side walls so that standard, commercially available batteries can be used as the energy storage device without incurring the disadvantage of having to opt for a bigger design of the implement integrating or incorporating the lighting means and, if necessary, the power consumer and energy storage device. Consequently, if the designs of the switch mechanism described above are used, the implement can be made with a width, as measured between the side walls, of between only approximately 4 mm and approximately 8 mm, for example approximately 4.8 mm and a maximum length of the implement will correspond to approximately only half the length of the pocket tool.

Another embodiment has advantages because the part-sections of the slim face adjoining the lighting means serve as a reflector for the emitted beam.

As a result of the stop nose arranged on the second side-end slim face of the housing case, the implement is fixed in its position when placed in the stowed position.

A gripping piece is provided on the second side-end slim face of the housing case, offset from the stop nose, and enables the implement to be easily moved out of the housing area with little force.

The energy storage device may be provided in the form of a battery or a solar cell.

In another embodiment, the implement has a display unit or LCD (liquid crystal display), the advantage of which is that the display unit, which might be susceptible to stress from pressure when being carried, for example in a trouser pocket, briefcase, etc., is protected from any inadvertent stress to which it might otherwise be subjected when the implement is pivoted into the stowed position inside the housing body. Any compression forces would then act exclusively on the high-strength cover plates of the pocket knife or base and cover plates of the tool card. If the display unit is additionally provided adjacent to the lighting means on or inside the implement, the functions of the implement can be further enhanced while nevertheless preserving the most compact structure, thereby making the pocket tool proposed by the invention suitable for a wide range of practical applications.

In another embodiment, the power consumer integrated in the implement may be provided in the form of an input device, so that the display unit may be used to perform mathematical calculations or input and output physical variables such as air pressure, temperature, altitude, etc. The input and display unit may advantageously be provided on the side wall of the housing case directed towards the user and may be provided in the form of an altimeter, compass, barometer, thermometer, hygrometer, speedometer, wind meter, a scale, a measuring device for radioactive irradiation, and/or a satellite navigation system, for example.

Also advantageous are embodiments of implements in which a microprocessor or transmitter and/or receiver module are provided inside the housing case, since this provides a simple means to enable a contactless data transfer between the microprocessor or transmitter and/or receiver module and a PC, such as an optical or radio transmission, etc., for evaluation of physical variables. The detected physical variables may be temporarily stored in the data memory.

In another option, the pocket tool proposed by the invention can be used as a stand-up pocket torch which can be placed on a work surface and the angular position of the pocket tool can be freely adjusted by the user relative to the work surface and the implement mounted on the lamp can be freely adjusted by the user relative to the housing body.

In accordance with the principles of the present invention, the switch connecting mechanism of the switch mechanism preferably has a retaining arm for the switch contact of a power consumer, in particular a lighting means, which is slidable in its longitudinal direction on a switch block in the region of a first terminal end extending parallel to its longitudinal direction and sits so that it can be pivoted relative to its bearing surface, lying so that it can be guided in its longitudinal direction on a guide block at its oppositely lying second terminal end, and the retaining arm is made up of a bending-resistant rocker arm section extending across less than half of its length perpendicular to its bearing surface, while the remaining part of the retaining arm is designed as a flexible arm section which tapers in the direction towards its oppositely lying, second terminal end, and the switch contact arranged on the second terminal end of the flexible arm section in the displacement region between the convexly shaped initial position and the extended operating position cooperates with a mating contact, in particular an energy storage device.

The surprising advantages of this arrangement are that, although requiring only a few individual components, a switch connecting system for a switch mechanism can be provided for switching a power consumer on and off, in particular a lighting means, and the operating element has to cover only short displacement paths, yet will reliably switch the retaining arm between an initial position, in which the lighting means is switched off, and an operating position, in which the light is switched on. As a result of the shorter displacement paths, the displaceable implement can be made to a small and compact design. For the purposes of the invention, the switch contact, in particular the connecting wire of the lighting means, is designed so that it is coupled with the retaining arm in displacement and the switch contact can be displaced simultaneously with the displacement of the retaining arm and operating element relative to a terminal face of a battery, so that in order to switch the lighting means on, the free end of the switch contact is moved towards the terminal face and placed against it, on the one hand, and, on the other, in order to switch the lighting means off, the free end of the switch contact is moved back away from the terminal face of the battery. Due to the fact that the current can be switched on and off by means of the terminal contact of the power consumer, in particular the lighting means, preferably directly, additional components which would otherwise be needed for an electronic switch can be dispensed with, making the construction of the entire switch mechanism much simpler.

In another embodiment, the retaining arm or the operating element is designed so that it can be locked in the initial and/or operating position.

This provides a reliable switching function and ensures that the retaining arm is securely fixed in the initial and operating positions. In its initial and operating positions, the retaining arm is secured in a positive-type fit by means of a catch nose locating in a catch recess. The catch recess and catch nose are preferably pressed one against the other, opposing the action of the compression force generated by the natural spring force of the retaining arm, which firmly fixes the initial and operating position eliminating any possibility of vibration.

The power consumer can be conveniently operated and is ergonomically designed for ease of handling in another embodiment, due to the fact that the bending-resistant rocker arm section incorporates the operating element projecting out from the freely accessible other slim face of the housing case. The top face of the operating element is also advantageously knurled, making it particularly easy to grip.

In another advantageous embodiment, the operating element is designed so that it can be displaced against the spring action of the region of the retaining arm which is resiliently elastic in the direction of an axis extending perpendicular to the longitudinal extension of the retaining arm. This ensures a reliable switching function of the operating element and retaining arm.

In another variant, the switch contact is coupled with the retaining arm in displacement and mounted so that it can be guided on a guide mechanism. This obviates the need for additional components that would otherwise be necessary for an electronic switch. The guide mechanism ensures that the switch contact is perfectly guided.

In one advantageous embodiment, the guide mechanism is disposed on one of the mutually opposing side faces of the retaining arm and has at least two spaced apart guide webs, one above the other, between which the switch contact is guided. The guide webs on the one hand ensure that a perfect electrical contact is established between the mating contact, which is preferably the energy storage device, and the electrically conductive switch contact when the retaining arm is in the operating position, and on the other hand ensure that the contact between the mating contact and the switch contact is reliably separated when the retaining arm is in the initial position. The guide webs arranged one above the other are disposed at a distance from the second terminal end of the retaining arm remote from the lighting means. The freely upstanding end of the switch contact, starting from the guide webs and extending in the direction of the second terminal end of the retaining arm, is mounted between the guide webs and may optionally be supported against a support surface of the switch block disposed in the region of the first terminal end of the retaining arm directed towards the lighting means. The advantage of this design is that even if a light pressing force is applied to the operating element, the second terminal end of the flexible arm section guided on the switch block is elastically deformed and moved in the direction towards the energy storage device and the free end of the switch contact is forced sufficiently firmly against the mating contact in order to establish an electrical contact with it and with the power consumer. The switch contact is only slightly elastically deformed, ruling out any possibility of its breaking, even after a large number of switching operations. In a preferred embodiment, the switch contact has several bends in the direction of its longitudinal extension, thereby imparting a sufficiently high bending resistance to it. The bending stiffness of the switch contact is higher than the bending stiffness of the flexible arm section. If it is not desirable for the connecting wire of the power consumer to be exposed to any mechanical stress, for example elastic bending, the switch contact is provided in the form of an elastically resilient leaf spring, which is electrically connected to the connecting wire of the power consumer.

Other features and advantages of the invention will become clear from the description given below with reference to the appended drawings.

BRIEF DESCRIPTION OF THE DRAWINGS

Examples of embodiments will now be explained in more detail with reference to the drawings. Of the drawings.

DETAILED DESCRIPTION OF PREFERRED EMBODIMENTS

Figure 3:
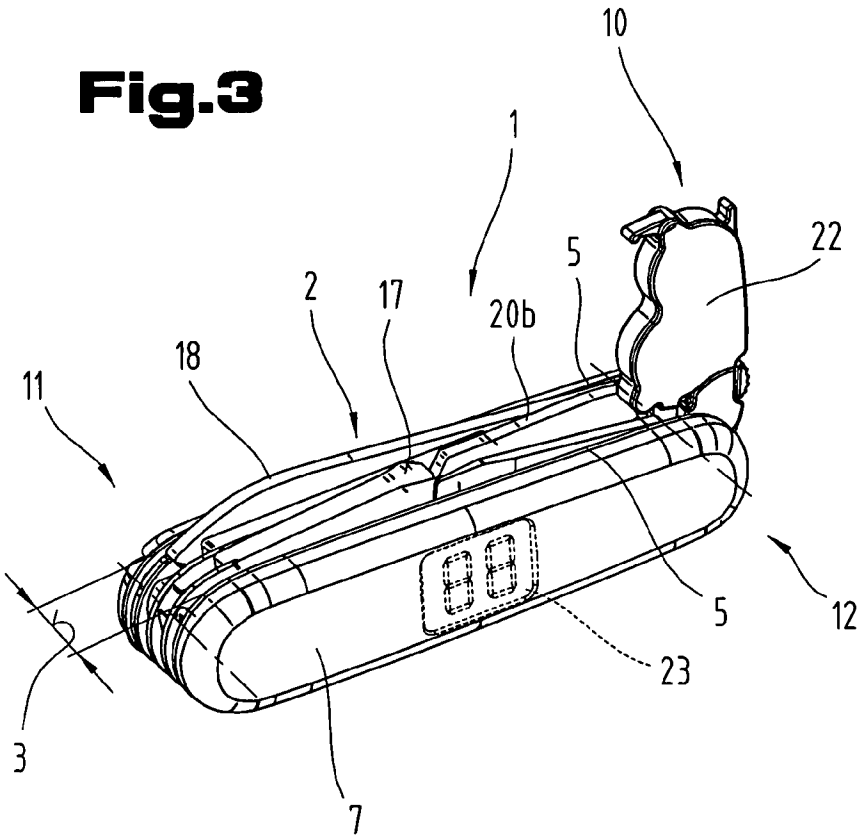
FIG. 3 is a schematic perspective view of the pocket tool illustrated in FIG. 1, with an implement pivoted out of the housing body into the operating position outside the housing body.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 1:
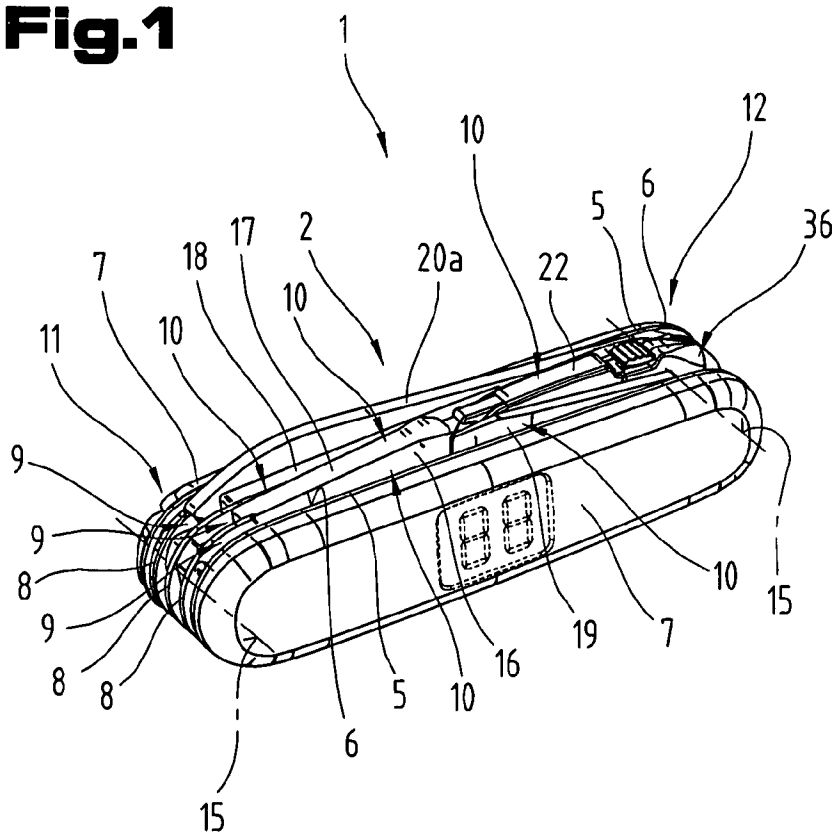
FIG. 1 is a schematic perspective view, showing a first embodiment of the pocket tool proposed by the invention with the implements pivoted into the stowed position inside the housing body.
Figure 2:
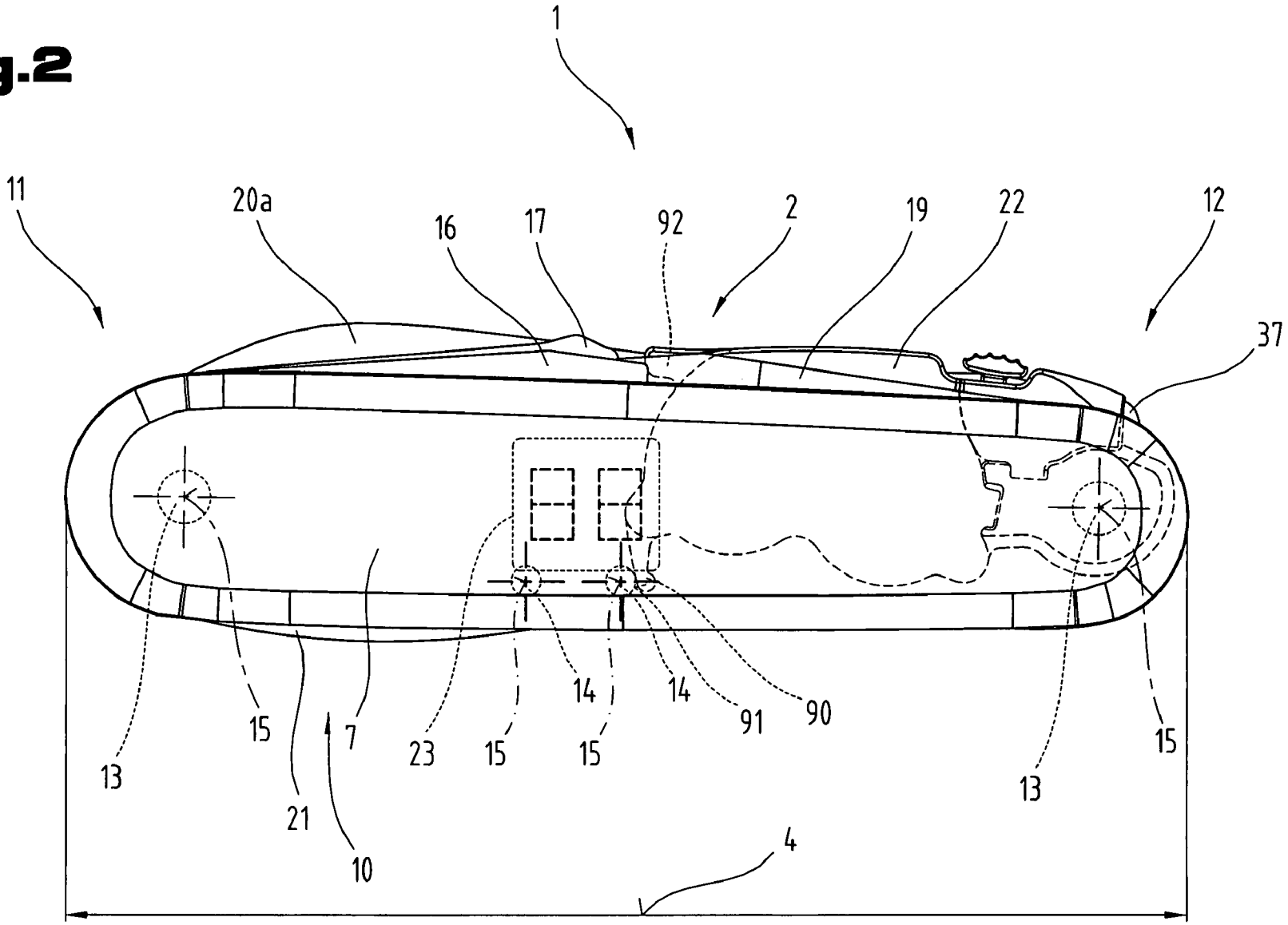
FIG. 2 is a highly simplified side view of the pocket tool illustrated in FIG. 1.
Figure 4:
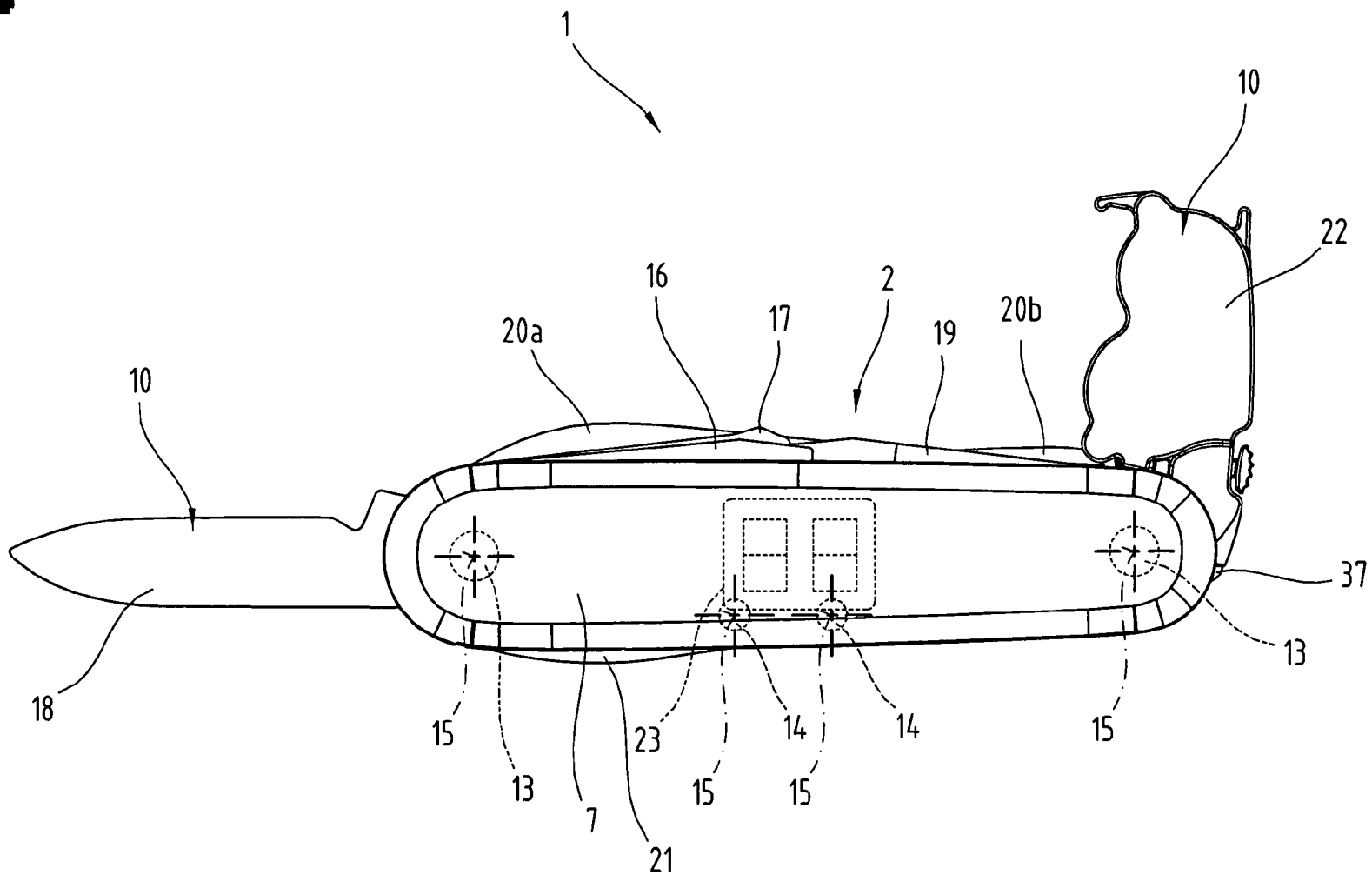
FIG. 4 is a simplified view of the pocket tool proposed by the invention and illustrated in FIG. 1, with the implements at its respective oppositely lying ends moved into the operating position outside the housing body.

FIGS. 1 to 4, which will be described together, illustrate different views of a pocket tool as proposed by the invention, in particular a pocket knife 1, with a housing body 2 made from metal and/or plastic, for example, which has a width 3 and a length 4 as measured at a right angle thereto. Housing body 2 has two mutually opposing external side walls 5, so-called external plates, which bound housing body 2 along width 3 and form parallel side faces 6 directed towards each other, covered on their mutually opposing external faces by a cover plate 7 made from opaque or transparent plastic, for example. In the embodiment illustrated as an example here, three dividing walls 8 or so-called center plates are provided between the two external side walls 5, and a shaft-type housing area 9 is provided between two mutually adjacent dividing walls 8 or between an external side wall 5 and a dividing wall 8, for at least one or two implements 10 which project therein. Each of housing areas 9 is at least partially bounded by a side wall 5 and dividing wall 8 or two dividing walls 8. The shaft-type housing areas 9 are at least partially separated from one another in several adjacently lying planes and extend parallel to side faces 6 of external side walls 5, running between mutually opposite terminal side end regions 11, 12 of the pocket tool. Although not illustrated in detail, cover plates 7 have bores recessed in their respective internal face directed towards the external side, specifically provided to accommodate rivets 13, 14, as illustrated in FIGS. 2 and 4, to affix cover plates 7 on the external side walls 5 of pocket knife 1, preferably by means of a push-fit seating. Rivets 13, 14, to be inserted in the bores, connect the individual side and dividing walls 5, 8 to each other and the implements 10 disposed between them are mounted so as to be pivotable thereon.

Implements 10, which in the embodiment illustrated as an example here are a screwdriver 16, a bit holder 17, and a knife blade 18, are mounted so as to pivot about an axis 15 indicated by dotted-dashed lines extending through rivet 14 arranged closer to the terminal first end region 11. Each of these implements 10 preferably is spring-biased by means of a spring, not illustrated, to be pivotable from a stowed position inside housing body 2 (as illustrated in FIG. 1) or housing area 9 into an operating position outside housing body 2 or housing area 9 (as illustrated in FIG. 4), preferably about approximately 90° or approximately 180°. Bit holders 17 of this type are already known from the prior art and are described in detail in patent specifications DE 298 24 770 U and WO 01/39629 A filed by the present applicant.

Other implements 10, such as a screwdriver 19 and two knife blades 20*a*, 20*b* of different lengths as well as a housing case 22 (which will be described in more detail below), are preferably pivotably mounted about an axis 15, indicated by dotted-dashed lines, by means of the rivet 13 closer to the other terminal end region 12 between the external side and dividing walls 5, 8. In this embodiment, screwdriver 19 and knife blades 20*a*, 20*b* are spring-biased by a spring, not illustrated, preferably about approximately 90° or approximately 180° respectively, from the stowed position inside housing area 9 into the operating position outside housing area 9.

The other rivet 14 is arranged approximately in the region of the half length 4 of pocket knife 1 between rivets 13 provided in the end regions 11 and 12 and constitutes another axis 15, indicated by a dotted-dashed line, about which another implement 10, such as a knife blade 21, is mounted so as to pivot by approximately 90° or approximately 180° from the stowed position inside housing area 9 into the operating position outside housing area 9. These implements 10 are intended as tools.

One of the implements 10 has a plate-type, substantially rectangular housing case 22, which is also preferably pivotably mounted about axis 15 from the stowed position inside housing area 9 illustrated in FIGS. 1, 2 into the operating position outside housing area 9 illustrated in FIGS. 3, 4.

As indicated by broken lines in FIGS. 1 to 4, at least one of cover plates 7 may be provided with at least an input and display unit 23 in the form of an LCD (liquid crystal display). The different applications and designs of such an input and display unit 13 and its advantages are known from patent specification WO 99/56918 A and constitute part of the subject matter of this disclosure.

FIGS. 5 to 8, which will be described together, illustrate different views of implement 10 which can be displaced relative to housing body 2 or housing area 9. Implement 10 has two housing parts 24*a*, 24*b* which are detachably connected to each other. First housing part 24*a* is provided in the form of a cover and has a side wall 25 a extending substantially parallel to the first side face 6 of housing body 2. Second housing part 24*b* has a side wall 25*b* extending substantially parallel to the second side face 6 of housing body 2 and a preferably integral peripheral ridge 26 projecting out perpendicularly from its substantially flat internal face in the peripheral region, in particular a rib-type thin peripheral web, so that when the cover is placed on second housing part 24*b*, as will be described in more detail with reference to FIG. 9, side walls 25*a*, 25*b* are spaced apart from each other and bound a cavity. At its terminal end, housing case 22, in particular second housing part 24*b*, also has a pivot bearing region 27 with a mounting bore 28 disposed concentrically with axis 15, which is mounted so as to be pivoted about axis 15. The shape of housing case 22 in the pivot bearing region 27 is that of a segment of a circle (such as a quarter circle or a half-circle). The segment shape imparts good torsional strength to the implement because forces are absorbed over a large surface area between the plates.

In the exemplary embodiment illustrated in FIGS. 5 to 8, housing case 22 has two housing compartments 30 lying adjacent to each other for two energy storage devices 31, such as batteries, disposed between side walls 25*a*, 25*b* in a plane extending parallel to side walls 25*a*, 25*b* and side faces 6 of housing body 2. Housing compartments 30 are at least partially separated from each other by means of a positioning projection 29. A longitudinal axis of the batteries extends perpendicular to side walls 25*a*, 25*b* and parallel to axis 15 of pivotable implement 10 or housing case 22.

Positioning projection 29 is integrally formed on the internal face and extends in a direction perpendicular to the internal face. Each of housing compartments 30 is bounded by accurately shaped part-sections 32 of peripheral ridge 26 facing housing area 9 and accurately shaped support surfaces 33 on positioning projection 29 respectively facing the oppositely lying part-sections 32. The energy storage devices 31 to be respectively fitted in housing compartments 30, which in this embodiment are cylindrically shaped batteries of a flat structure, fit respectively between support faces 33 of positioning projection 29 and support faces 34 of part-sections 32 of peripheral ridge 26 and are supported against a terminal face of the battery at the support faces 33, 34. In a preferred embodiment, energy storage devices 31 are retained in position in housing compartments 30 by means of friction between support faces 33 of positioning projections 29 and support faces 34 of part-sections 32 of peripheral ridge 26. Positioning projection 29 used for this purpose may be made from a heat-deformable plastic, such as elastomer, for example.

As may also be seen from the individual drawings, housing case 22 has at least one compartment 35 of a half-shell shape, which is open towards the internal face of the oppositely lying cover and in which at least one power consumer 36 is partially inserted. In the embodiment illustrated as an example here, power consumer 36 is a lighting means 37, such as lamp. This standard, commercially available lamp, for example an LED (light-emitting diode) or IRED (infrared-emitting diode), is primarily characterized by its long life, low energy consumption and the fact that it can be adapted to a whole range of applications in terms of the different colors of lamps which may be used. An end face of compartment 35 is open towards the exterior at a side-end first slim face 38 extending between the mutually opposite side walls 25*a*, 25*b* in the transverse direction of implement 10 and, when placed in compartment 35, power consumer 36 optionally extends slightly from the side-end, first slim face 38. A longitudinal axis of lighting means 37 and/or compartment 35 for the lighting means 37 extends at least at an angle, in particular substantially perpendicular to the side-end first slim face 38 of housing case 22. Housing case 22 is bounded by two oppositely lying side-end slim faces 38 and two other oppositely lying slim faces 38 extending therebetween.

Disposed in housing case 22 is power consumer 36, such as in the form of at one lighting means 37, which can be switched on and off by means of a switch mechanism 39. Switch mechanism 39 for operating lighting means 37 incorporating implement 10 has a switch connecting system with a retaining arm 40 for at least one switch contact 41*a*, and an operating element 42. Retaining arm 40 of the switch connecting system may be formed in a strip-shaped configuration and may be mounted so as to be guided between the two housing parts 24*a*, 24*b* and side walls 25*a*, 25*b* in an axial and transverse direction. Retaining arm 40 is connected to an operating element 42, in particular an operating button, which projects out from the top or other slim face 38 of housing case 22 remote from housing body 2 and freely accessible to the user.

A displacement path 44 of operating element 42 for displacing retaining arm 40 and thus operating the power consumer 36 or lighting means 37 is restricted by mutually opposite end-side stop surfaces 45 of an orifice 43. Operating element 42 has a shaft linked to retaining arm 40 and a gripping piece 46 with knurling, the shaft extending through the other slim face 38, in particular through orifice 43 of peripheral ridge 63 (see FIG. 9) of first housing part 24*a* and/or peripheral ridge 26 (see FIG. 6) of second housing part 24*b*. Retaining arm 40, a part of which is of an elastically resilient design, is preferably made from plastic by an injection molding process.

In the region of its first terminal end 47 facing power consumer 36 and in the region of its second terminal end 50 facing energy storage device 31, the longitudinally extending retaining arm 40 forms a respective bearing surface 49 supported on a switch block 48 on the one hand and on a guide block 51 on the other. The switch and/or guide blocks 48, 51 each form a support surface facing bearing surfaces 49, extending perpendicular to side wall 25*b* and substantially accurately curved in the longitudinal direction of retaining arm 40. The support surface of switch block 48 may also be of a substantially flat design, whereas at least the support surface of guide block 51 is almost arcuately curved, and in particular is of a convex design facing second bearing surface 49 of second terminal end 50. In the region of its first terminal end 47, retaining arm 40 longitudinally slideable with respect to the first bearing surface 49 on guide block 48 extending parallel to its longitudinal direction, as well as pivotable relative to the first bearing surface 49. The oppositely lying second terminal end 50 sits so as to be guided by the second bearing surface 49 on guide block 51 in the longitudinal direction of retaining arm 40.

To this end, the positioning projection 29 described above is provided on the side incorporating guide block 51 so that the support surface faces retaining arm 40 and the support surface extends in a substantially accurately curving arrangement between the accurate support faces 33 oriented perpendicular to the internal face.

Switch block 48 is provided in the form of a spacing web 55 oriented perpendicular to the internal face and extending at least across a part of an internal height as measured between the mutually facing internal faces of the two housing parts 24*a*, 24*b*.

Retaining arm 40 has a rocker arm section 53 extending across less than the half of its length, which is resistant to bending in the direction substantially perpendicular to the first bearing surface 49 or support surface of switch block 48. Linked to rocker arm section 53 is operating element 42, which is disposed in the longitudinal direction of retaining arm 40. More than half of the length 52 of retaining arm 40, in particular the remaining part of retaining arm 40, is provided in the form of a flexible arm section 54 tapering in the direction towards second terminal end 50 of retaining arm 40. Switch contact 41*a* on flexible arm section 54 is disposed in the region of second terminal end 50 and cooperates with a mating contact, such as energy storage device 31, in the displacement region between the accurate, convex-shaped initial position of retaining arm 40 (illustrated in FIG. 6), and the virtually extended operating position of retaining arm 40 (as illustrated in FIGS. 7 and 8).

The strip-shaped retaining arm 40 forms mutually parallel side faces 56 which are also parallel to side walls 25*a*, 25*b* and side faces 6. Two guide webs 58*a*, 58*b* are expediently arranged transversely to the longitudinal extension of retaining arm 40, one above the other and spaced apart on one side face 56, spaced at a distance from second terminal end 50. Guide webs 58*a*, 58*b* each extend across a part of length 52 of retaining arm 40 and flexible arm section 54, forming a guide mechanism. The distance between guide webs 58*a*, 58*b* at least matches a main dimension 57, e.g., diameter or wall thickness, of first switch contact 41*a* or which is slightly bigger than the main dimension 57. Guide webs 58*a*, 58*b* are expediently disposed more or less at the center of flexible arm section 54. Flexible arm section 54 has a lower resistance to bending than rocker arm section 53.

Switch contact 41*a* extends the first terminal end 47 facing compartment 35 towards second terminal end 50 lying opposite it, and is guided between guide webs 58*a*, 58*b* and preferably supported by the support face of the switch block. As may be seen from the drawing, the free end extends slightly from the first switch contact 41*a* at the second terminal end 50 of the retaining arm 40.

The electrically conductive first switch contact 41*a* is electrically connected to power consumer 36 or is the actual power consumer 36. In the first of these cases, switch contact 41*a* is provided in the form of an electrically conductive leaf spring, for example, which can be connected by an adapter, e.g., plug connection, to a terminal contact of power consumer 36. In the latter case, switch contact 41*a* is provided in the form of the terminal contact, or the terminal wire forming it, of power consumer 36, such as in the form of a lighting means 37, in which case it will be in the form of a bar.

Figure 6:
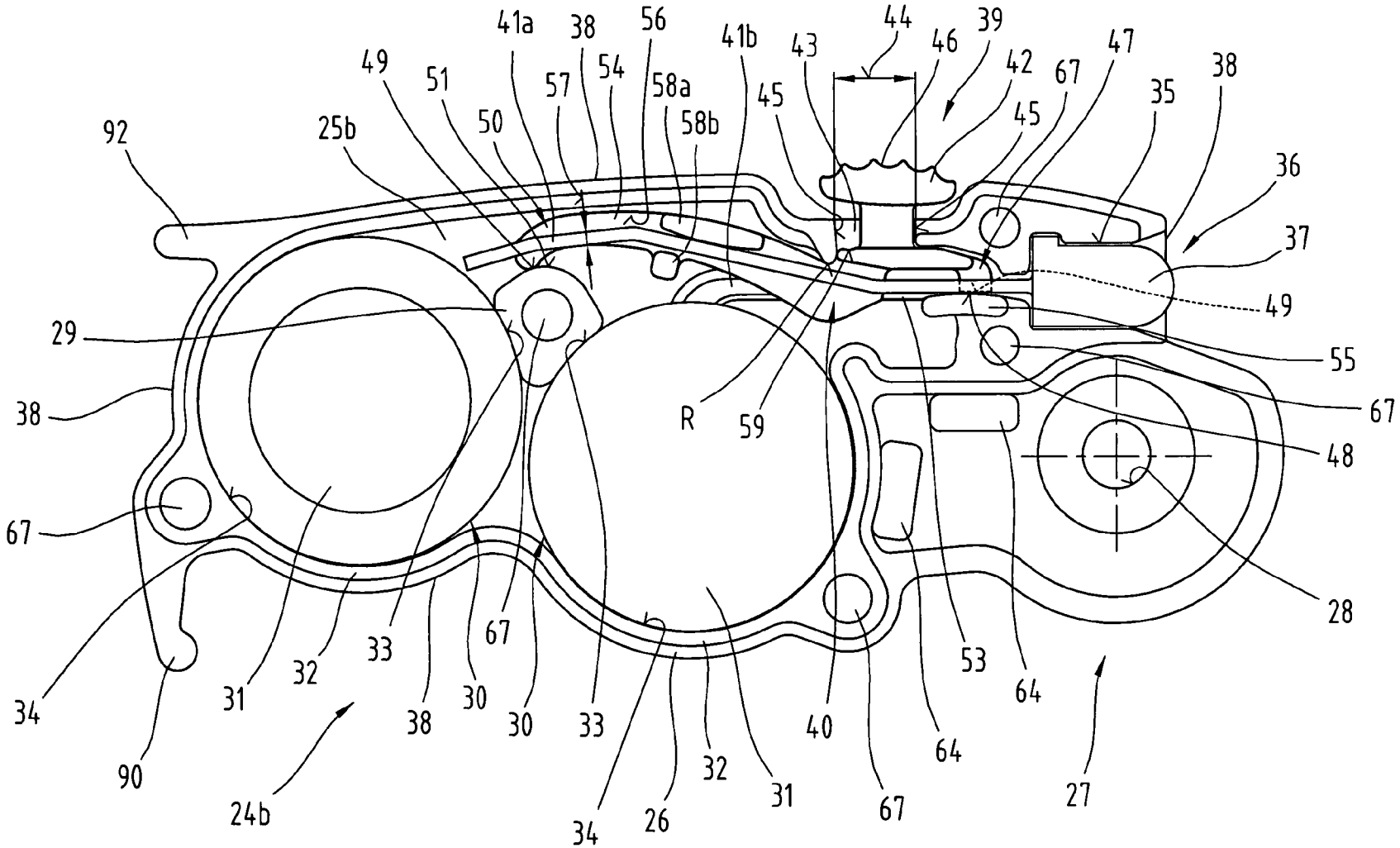
FIG. 6 is a schematic diagram showing the internal face of a second housing part of the housing case of the implement illustrated in FIG. 5 with a switch mechanism for operating a power consumer, such as a lighting means, in its switched-off switch position.
Figure 7:
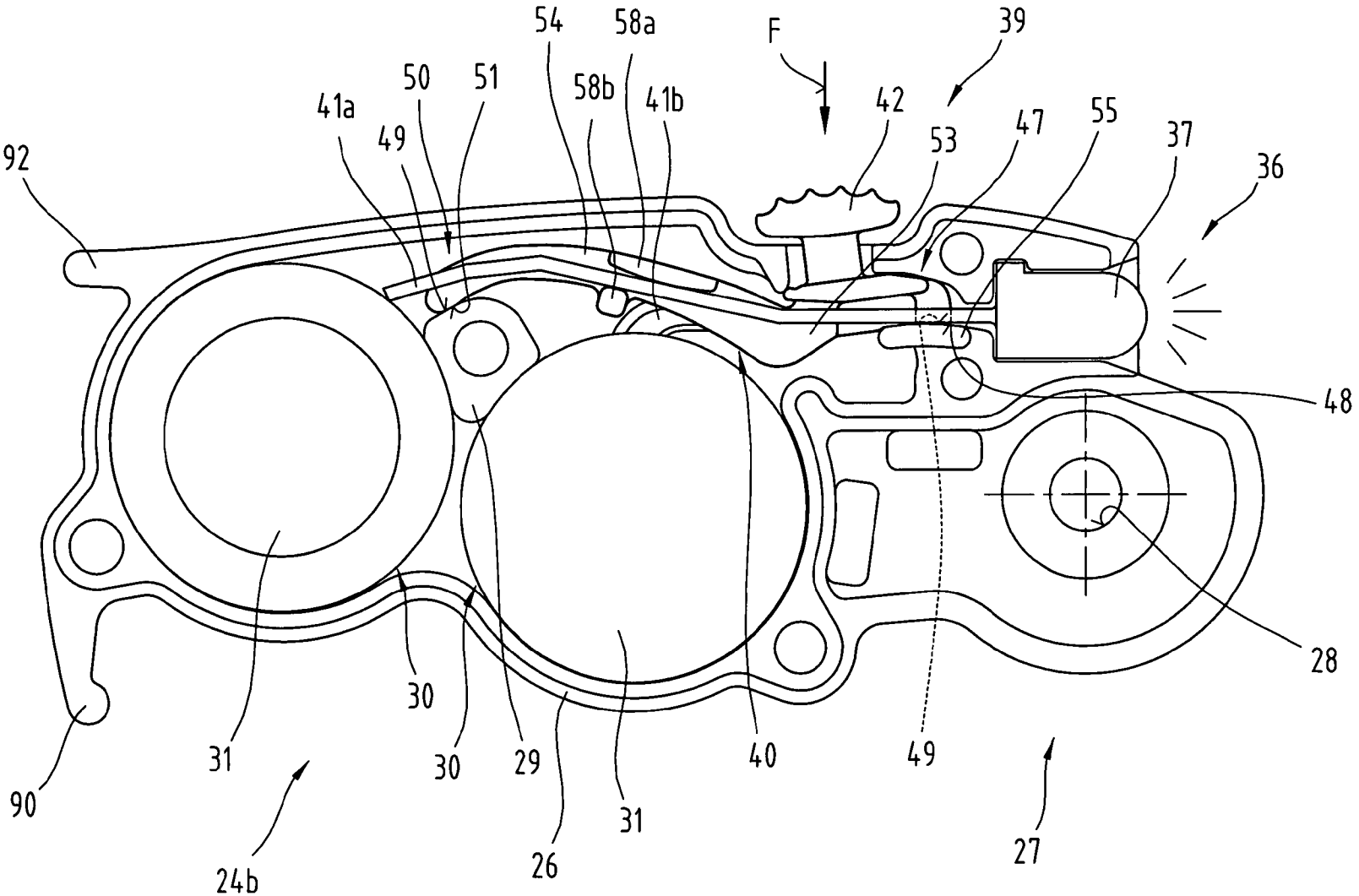
FIG. 7 is a schematic diagram of the internal face of the second housing part of the housing case of the implement illustrated in FIG. 5 with the switch mechanism for operating a power consumer, such as a lighting means, in its switched-on switch position.
Figure 8:
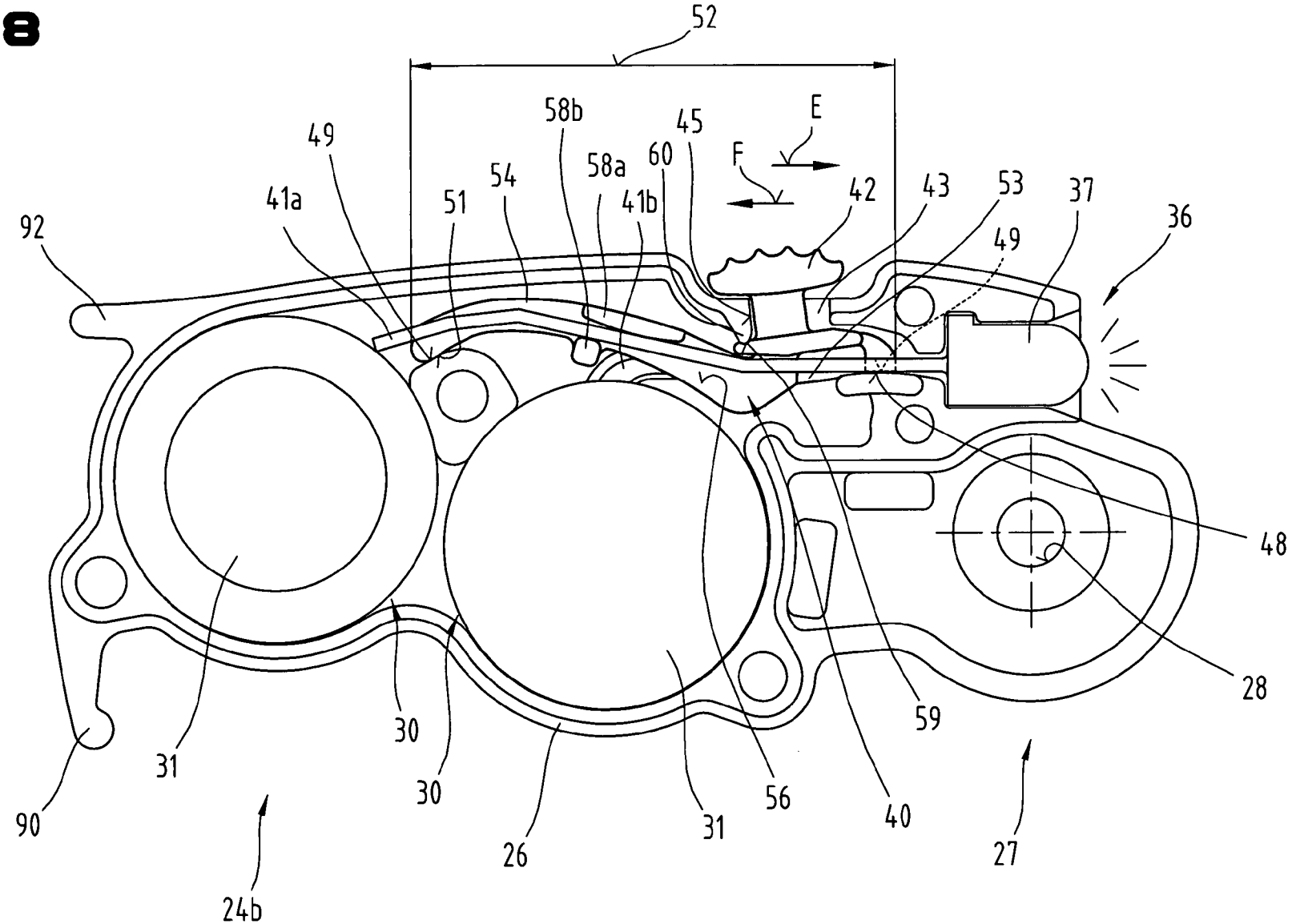
FIG. 8 is a schematic diagram of the internal face of the second housing part of the housing case of the implement illustrated in FIG. 5 with the switch mechanism for operating a power consumer, such as a light means, in its switched-on switch position.

As may also be seen from FIGS. 6 to 8, power consumer 36 is electrically connected by means of an electrically conductive switch contact 41*b* to a negatively charged terminal face of energy storage device 31, for example. The electrically conductive switch contact 41*b* is provided in the form of a wire connection, which can be connected via an adapter, e.g., a plug connection, to a terminal contact of power consumer 36, or in the form of the terminal contact, or the wire forming it, of power consumer 36, in particular lighting means 37.

The two energy storage devices 31 are electrically connected to each other by a contact bridge 68 (FIG. 9), which will not be described in detail, and the current circuit consisting of energy storage devices 31 and the lighting means is closed when operating element 42 is biased by a compression force applied in the direction perpendicular to the longitudinal extension of retaining arm 40—as indicated by arrow "F" in FIG. 7. As a result of this compression force "F", rocker arm section 53 is pivoted about an axis extending perpendicular to side face 56 of retaining arm 40 and flexible arm section 54 is elastically deformed so that the convexly shaped flexible arm section 54 is shifted from its initial position illustrated in FIG. 6 into the substantially extended operating position illustrated in FIG. 7. Because of the bending line of flexible arm section 42 resulting from the effect of the compression force, the free end of switch contact 41*a* with its plurality of bends establishes an electrical connection with a mating contact, such as a positively charged terminal face of energy storage device 31. Under the effect of the compression force "F", flexible arm section 42 is therefore elastically deformed so that the second bearing face 49 of flexible arm section 54 is moved along the support face of guide block 51 during this deformation, towards energy storage device 31. Since switch contact 41*a* is coupled with retaining arm 40, in particular flexible arm section 54, in displacement, the free end of switch contact 41*a* is also moved in the direction towards energy storage device 31 and applied against the positive terminal face of energy storage device 31. Consequently, the electric power circuit is closed and power consumer 36 draws electrical energy from energy storage device 31 and starts to light up lighting means 37 provided in this embodiment.

As long as a compression force "F" is applied to operating button 42, lighting means 37 is lit. Once the compression force "F" is released, the elastically deformed flexible arm section 54 of retaining arm 40 is automatically returned from its operating position into its initial position and as it is so, the second bearing surface 49 of retaining arm 40 slides along the support face of guide block 51 towards rocker arm section 53, and as flexible arm section 54 is returned, the region of switch contact 41 which is slightly elastically deformed when retaining arm 40 is in the operating position is likewise deformed back to its original initial shape and switch contact 41*a* is moved away from energy storage device 31, causing the power supply to lighting means 37 to be interrupted so that lighting means 37 is turned off.

When retaining arm 40 is in the operating position, guide webs 58*a*, 58*b* serve as a counter bearing for switch contact 41*a*, ensuring that switch contact 41*a* itself is reliably pressed against and abuts the opposite contact the energy storage device 31 with a low compression force "F". Guide web 58*b* remote from operating element 42 acts as a counter bearing for switch contact 41*a* as retaining arm 40 is displaced into its initial position, as a result of which switch contact 41*a* is reliably moved away from and lifted off the opposite contact and energy storage device 31. As illustrated, this means that switch contact 41*a*, in particular at least the free end of the slightly resiliently elastic switch contact 41*a*, and/or retaining arm 40, in particular flexible arm section 54, may be designed so as to be displaceable relative to the opposite contact and energy storage device 31.

As may be seen in more detail in the drawings, guide webs 58*a*, 58*b* are disposed on flexible arm section 54 spaced apart from free second terminal end 50 on flexible arm section side and from the free end of switch contact 41*a*. This spacing provides optimum leverage in the operating position, so that switch contact 41*a* is able to establish an electrical contact with energy storage device 31 with only a light compression force "F". As a result of this function illustrated in FIG. 7, switch mechanism 39 cooperates with switch block system as a push button.

As illustrated in FIG. 8, the electric circuit between the energy storage devices 31 and the at least one power consumer 36 is closed when operating element 42 is pushed as indicated by arrow "F" in the direction parallel to the longitudinal direction of retaining arm 40 and pivoted about an axis perpendicular to side faces 56 of retaining arm 40 shortly before reaching stop surface 45 and displaced in the direction of retaining arm 40, so that retaining arm 40 is locked in its operating position, thereby allowing pocket knife 1 to function as a torch, for example. In order to lock retaining arm 40 in the operating position, a catch nose 60 is provided in the region of top surface 45 which locates in a catch recess 59. This catch recess 59 is disposed on a top face of retaining arm 40 or operating element 42 directed towards catch nose 60 and is of a design complementing catch nose 60, at least in certain regions.

Consequently, retaining arm 40 is locked in its operating position, even if no compression force is acting in the direction perpendicular to the longitudinal extension of retaining arm 40. The way in which retaining arm 40 is displaced as well as its design were explained above and this part of the description may be read in conjunction with this drawing. When retaining arm 40 is in the operating position, the circuit is closed and lighting means 37 lights up.

In order to switch lamp 37 off, a compression force must firstly be applied to operating element 42 in a direction perpendicular to the longitudinal extension of retaining arm 40 so that catch recess 59 and catch nose 60, which are located with each other in a form-fit connection, can be released by moving catch recess 59 away from catch nose 60, as a result of which operating element 42 is displaced together with retaining arm 40 in the direction of arrow "E". Switch contact 41*a* and retaining arm 40 are then in the initial position illustrated in FIG. 6. Switch mechanism 39 therefore corresponds to a switch.

As may also be seen from FIG. 6, retaining arm 40 is locked when retaining arm 40 is in the initial position, by means of another catch recess "R" which locates with catch nose 60 in a form-fit arrangement. This catch recess "R" is provided on a top face of retaining arm 40 or operating element 42 directed towards catch nose 60 and complements the shape of catch nose 60, at least in certain regions. Retaining arm 40, with its mutually opposite bearing surfaces 49 at terminal ends 47, 50 supported on the switch and guide locks 48, 51, is pressed with its catch recess "R" against catch nose 60 in the initial position and optionally with its catch recess 59 against catch nose 60 in the operating position, and is so with a predetermined retaining force due to the resiliently elastic flexible arm section 54 in the initial position, so that retaining arm 40 is prevented from inadvertently shifting of its own accord and cannot change the operating state of the power consumer 36.

It should also be pointed out that housing case 22 of implement 10 may also be made up of at least two or three flat plates, which are joined to one another, in particular glued or bonded, at their mutually facing widthways faces and housing compartments 30 for energy storage device 31, mounting bore 28, opening 43 for operating element 42 as well as seating 35 for power consumer 36 are recessed at the widthways face of one or both plates. However, this embodiment is not illustrated. Housing parts 24*a*, 24*b* of housing case 22 and retaining arm 40 may be made from plastic, preferably by an injection molding process. Retaining arm 40 may be manufactured by a multi-component injection casting process and may have different properties in terms of elasticity and bending resistance in the direction of its longitudinal extension.

Figure 9:
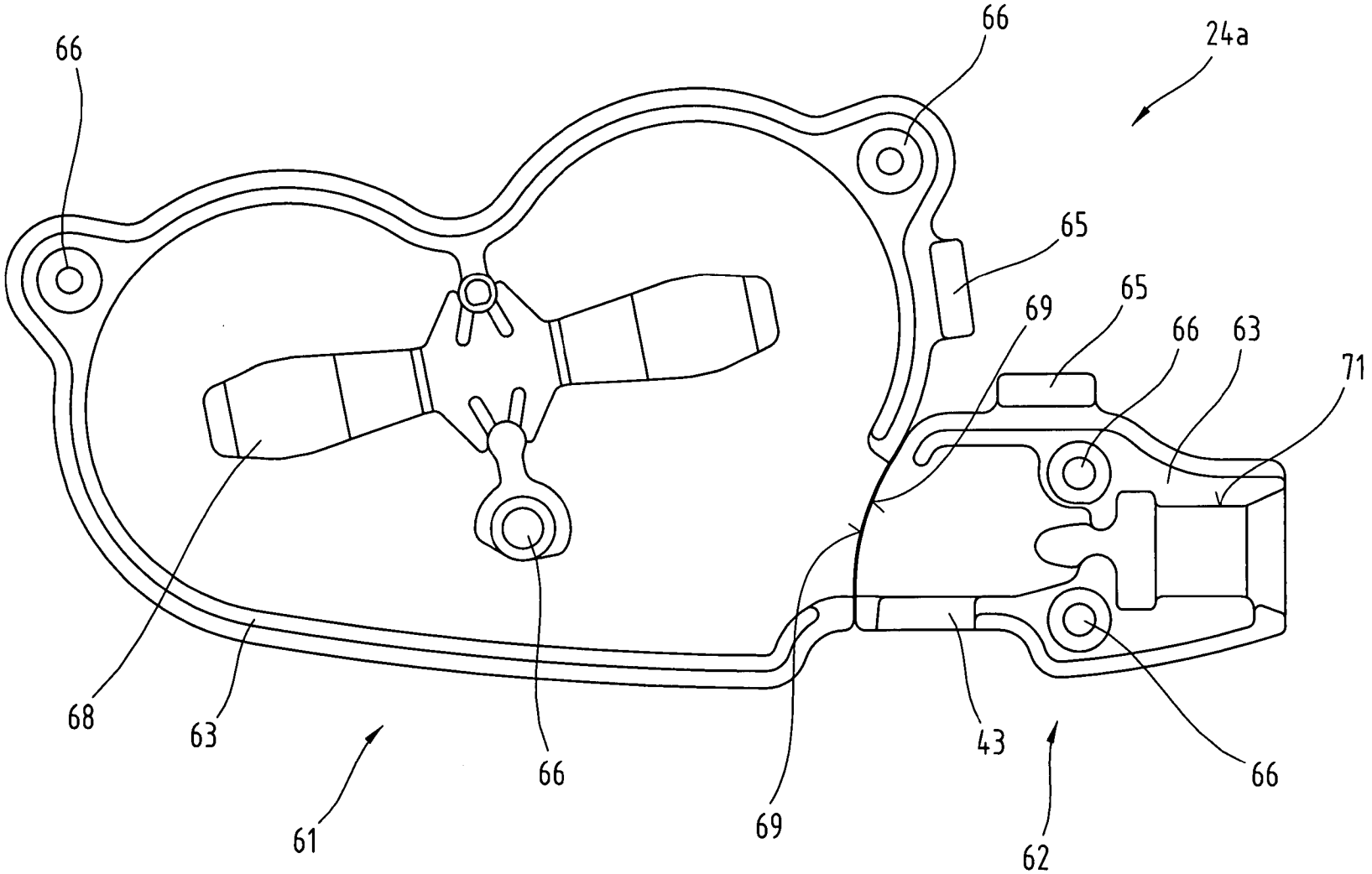
FIG. 9 is a schematic diagram of the internal face of the first housing part of the housing case illustrated in FIG. 5.

FIG. 9 is a highly simplified schematic diagram showing a view onto the substantially flat internal face of first housing part 24*a* or cover with a contour complementing that of second housing part 24*b* making up housing case 22. First housing part 24*a* may be a single part or, as illustrated in this embodiment, made up of two parts. First housing part 24*a* may be made from plastic and comprises first and second housing part-sections 61, 62 or cover part. First housing part-section 61 is provided with a preferably integrally formed peripheral edge 63 in the peripheral region which stands out perpendicular from the internal face, in particular a peripheral web, and covers housing compartments 30 for energy storage devices 31 as well as a part-region of the switch connecting mechanism of switch mechanism 39 illustrated in FIGS. 6 to 8. This arrangement ensures that the sensitive region where the electronics are disposed is kept sealed and protected from water spray or high air humidity, so that it will be fully functional even during bad weather conditions, e.g., rain, snow, ice, etc.

First housing part-section 61 is also provided with at least one hook-shaped catch or snap-fit element 65, which locates behind a recess 64 (FIG. 5) on second housing part 24*b* and, in the embodiment illustrated as an example here, three cylindrical pins 66 distributed about the internal face, which are pushed into complementary bores 67 in second housing part 24*b*. The at least one catch or snap-fit element 65 and pins 66 are aligned vertically to the internal face and extend out from the internal face, the catch or snap-fit element 65 and the pins 66 expediently being made from plastic and integrally molded on first housing part-section 62 by an injection molding process.

As may also be seen from FIG. 9, first housing part-section 61 is provided with an electrically conductive contact bridge 68 on the internal face, so that when first housing part-section 61 is placed on second housing part-section 24*b* the two energy storage devices 31 are electrically connected to each other.

When first housing part-section 61 is placed on second housing part 24*b*, peripheral ridges 26, 63 or peripheral webs sit adjacent to one another in a preferred embodiment and to a certain extent form a double wall. A sealing element made from plastic for example, in particular elastomer, not illustrated, is inserted between the adjacently lying peripheral ridges 26, 63. Otherwise, another option is for peripheral ridges 26, 63 to sit immediately adjacent to one another and, when first housing part-section 61 is placed on second housing part 24*b*, mutually facing terminal edges of peripheral ridges 26, 63 sit in abutment with one another with a flat seal inserted therebetween.

Consequently, when first housing part-section 61 is placed on second housing part 24*b*, a space is left free by means of at least one of peripheral ridges 26, 63 between mutually facing internal faces of first and second housing parts 24*a*, 24*b*. The internal faces extend parallel to side faces 6. Peripheral ridge 63 extending around the peripheral region of first housing part-section 61 is interrupted at a slim face of housing part-section 61, forming an orifice 69.

As mentioned above, in a preferred embodiment, first housing part has a second housing part-section 62 adjacent to the first housing part-section 61, directly adjoining the slim face of first housing part-section 61 and immediately adjoining orifice 69 formed in peripheral edge 63 at the slim face. As may be seen from the drawing, second housing part-section 62 is provided with a complementary orifice 69, so that a passage is formed between the two housing part-sections 61, 62.

Second housing part-section 62 also has an integrally formed peripheral ridge 63 in the peripheral region, which projects out vertically from the internal face and is provided with orifice 69 in a slim face facing first housing part-section 61 as well as a terminal-end half-shell-shaped recess 71 open towards the exterior on the slim face lying opposite orifice 69. Opening 43 is also provided in peripheral ridge 63. This recess 71 is open towards the internal face of the oppositely lying second housing part 24*b* and partially accommodates at least one power consumer 36. This second housing-part section 62 has at least one integrally formed hook-shaped catch or snap-fit element 64 and/or at least two pins 66, by means of which it is affixed in a positive and/or non-positive connection to second housing part 24*b*. To this end, second housing part 24*b* is provided with a recess 64, in which the catch or snap-fit element locates in a positive connection, and the internal face has recessed bores 67 in which the complementary pins 66 can be located in a non-positive connection.

A sealing element made from plastic, in particular elastomer, may also be provided between second housing part-section 62 bridging a part-region of the switch connecting mechanism of switch mechanism 39 and power consumer 36 and second housing part 24*b*. This being the case, power consumer 36 is retained in a positive and/or non-positive arrangement between housing parts 24*a*, 24*b* in compartments 35, 71, which are disposed in symmetrical mirror image relative to the dividing plane between housing parts 24*a*, 24*b*.

In another embodiment of first housing part 24*a*, although not illustrated, the latter is made as a single piece, in which case peripheral ridges 63 need not sit in flat abutment with one another in the region of orifices 69 as is necessary with the two-part embodiment, and instead, only a single peripheral ridge 63 is provided, which runs on the internal face around the entire peripheral region, extending along the slim face and merging into recessed seating 71 for consumer 36. The two housing part-sections 61, 62 are joined to each other in this case and form the single-piece first housing part 24*a*.

Naturally, another possibility would be for first housing part 24*a* or housing part-sections 61, 62 and second housing part 24*b* to be detachably or non-detachably connected to each other by a screw connection, adhesive, bonded or welded joint or clamp connection, thereby forming the implement 10.

Figure 10:
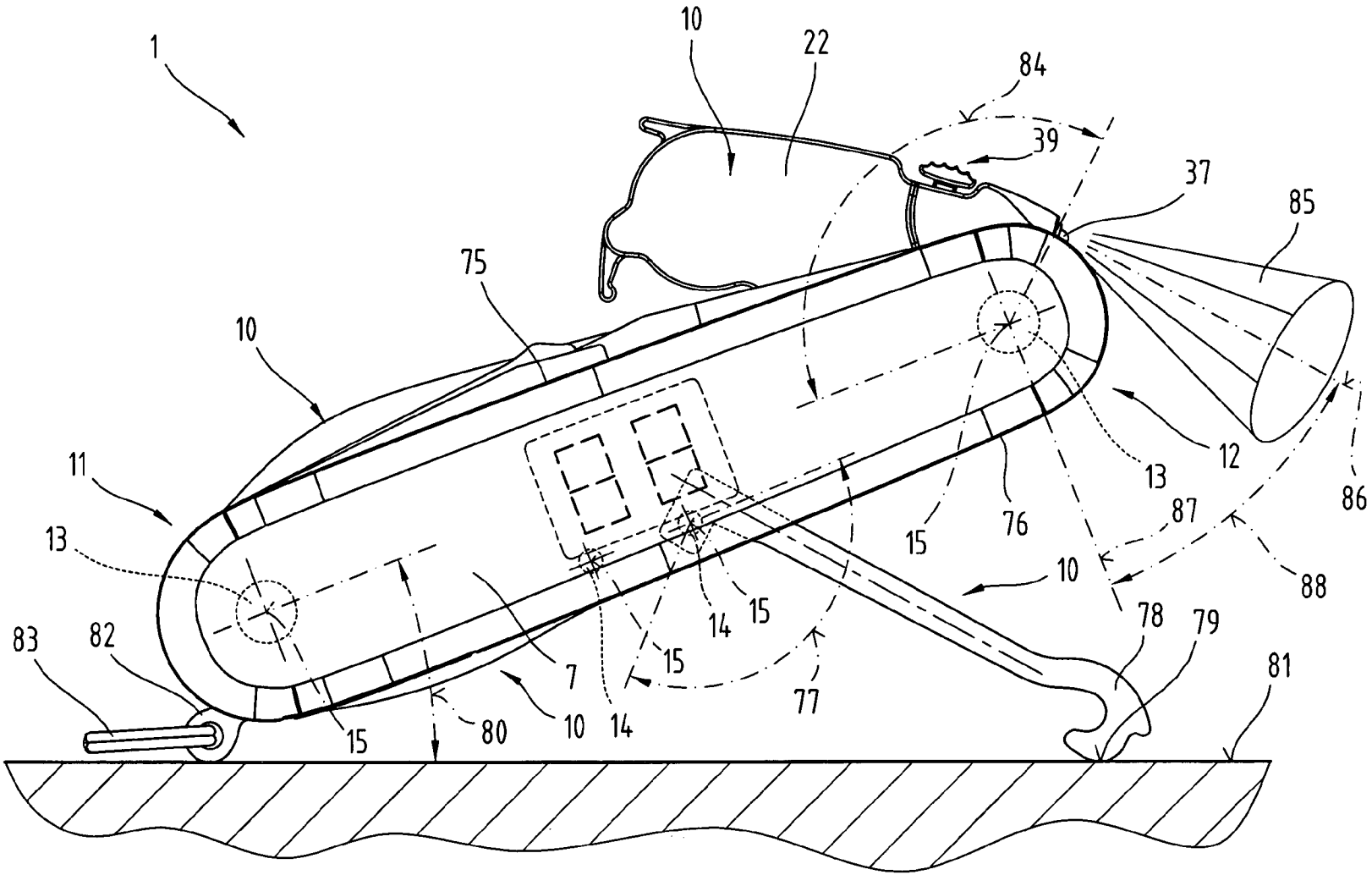
FIG. 10 is a schematic diagram showing a side view of a pocket knife illustrating an example of how it can be used as a stand-up lamp, with the implements extracted into the operating position outside the housing body.

FIG. 10 illustrates an example of one possible use of the pocket tool or pocket knife 1 proposed by the invention. In addition to implements 10 which can be displaced relative to first slim face 75, the pocket tool has several other implements 10, which can be pivoted out relative to a second slim face 76 extending parallel to the first slim face 75, against the action of springs, not illustrated, from the stowed position illustrated in FIG. 1 into the operating position illustrated in FIG. 10. A pre-settable pivot angle 77 between the stowed position and the maximum operating position of another implement 10 is between approximately 0° and approximately 135° and an operating position can be set within the range of pivot angle 77 between approximately 20° and approximately 135°, in particular between approximately 45° and approximately 120°, for example approximately 45°. In the embodiment illustrated as an example here, this other implement 10 is provided in the form of a hook 78, comprising a shaft-shaped element with the actual hook 78 at one end, while the other end is offset from the mid-axis of the shaft forming a pivot-bearing region and can be pivoted about axis 15. The extracted other implement 10 preferably has a support surface 79 at its end lying opposite housing body 2 and pivot-bearing region, by means of which the pocket tool can be placed on a working surface 81 and adjusted to a pre-settable angular position 80, for example inclined at approximately 30°, 40°, 50°, 60°, 70° relative to working surface 81. The other implement 10 is mounted so as to pivot between side walls 5 about another axis 15 arranged offset from axis 15 of first implement 10 incorporating lighting means 37 in the longitudinal direction of the pocket tool. Alternatively, the other implement 10 may also be mounted about axis 15 of first implement 10 incorporating lighting means 37 in one of end regions 11, 12.

In this embodiment, the pocket tool is provided with an eye 82 at its one end region 11, by means of which the pocket tool can be supported on the work surface 81 with the end region 11. A ring 83 is arranged through the eye 82. This ring 83 may have a nail or a screw, not illustrated, thereby enabling the position of the pocket knife 1 to be fixed once it has been set down.

As may be seen from this drawing, implement 10 which can be displaced, in particular pivoted, relative to first slim face 75 of the pocket knife 1 and incorporating a lighting means 37 which can be switched on and off, can be freely adjusted in terms of its angular position so that working surface 81 is fully illuminated in a desired area. Implement 10 incorporating lighting means 37 can be freely adjusted from the stowed position to the operating position within an adjustment angle 84 of between approximately 0° and approximately 120° subtended by a longitudinal axis of the pocket tool and a longitudinal axis of implement 10.

To obtain optimum illumination and light intensity as well as brightness at work surface 81, adjustment angle 84 for the operating position is between 0° and 90°, in particular between 30° and 70°, for example 45°. By varying the adjustment angle 84 of the implement 10 within the operating position, the angle of incidence of the lighting means or a conical beam 85 emitted by a LED can be adjusted to an optimum setting, which is a major advantage if the ambient light undergoes considerable change.

To enable energy storage device 31 and/or power consumer 36, in particular at least one lighting means 37, to be replaced, implement 10 can be pivoted out by between approximately 90° and approximately 120° within the adjustment angle 84 for the operating position, first housing part 24*a* or first housing part-section 61 removed from second housing part 24*b* and the replacement made. In this operating position between approximately 90° and approximately 120°, housing compartments 30 are freely accessible once first housing part 24*a* has been removed, unhampered by the spatially limited dimensions of housing body 2 of the pocket tool.

As may be seen in FIG. 10, an axis of symmetry 86 of conical beam 85 emitted by lighting means 37 and a plane 87 perpendicular to the longitudinal axis of the pocket tool subtend an angle 88. This angle 88 preferably is freely adjustable and in this particular embodiment is approximately 90° when implement 10 is in the stowed position and approximately 0° when implement 10 is in the operating position.

Naturally, lighting means 37 may be of different colors in order to cater for different uses and may be a red, green, yellow or blue lighting means 37. Disposed between housing parts 24*a*, 24*b*, lighting means 37 is arranged eccentrically relative to bearing bore 28 on the side-end first slim face 38 of housing case 22 (see FIG. 5).

Figure 5:
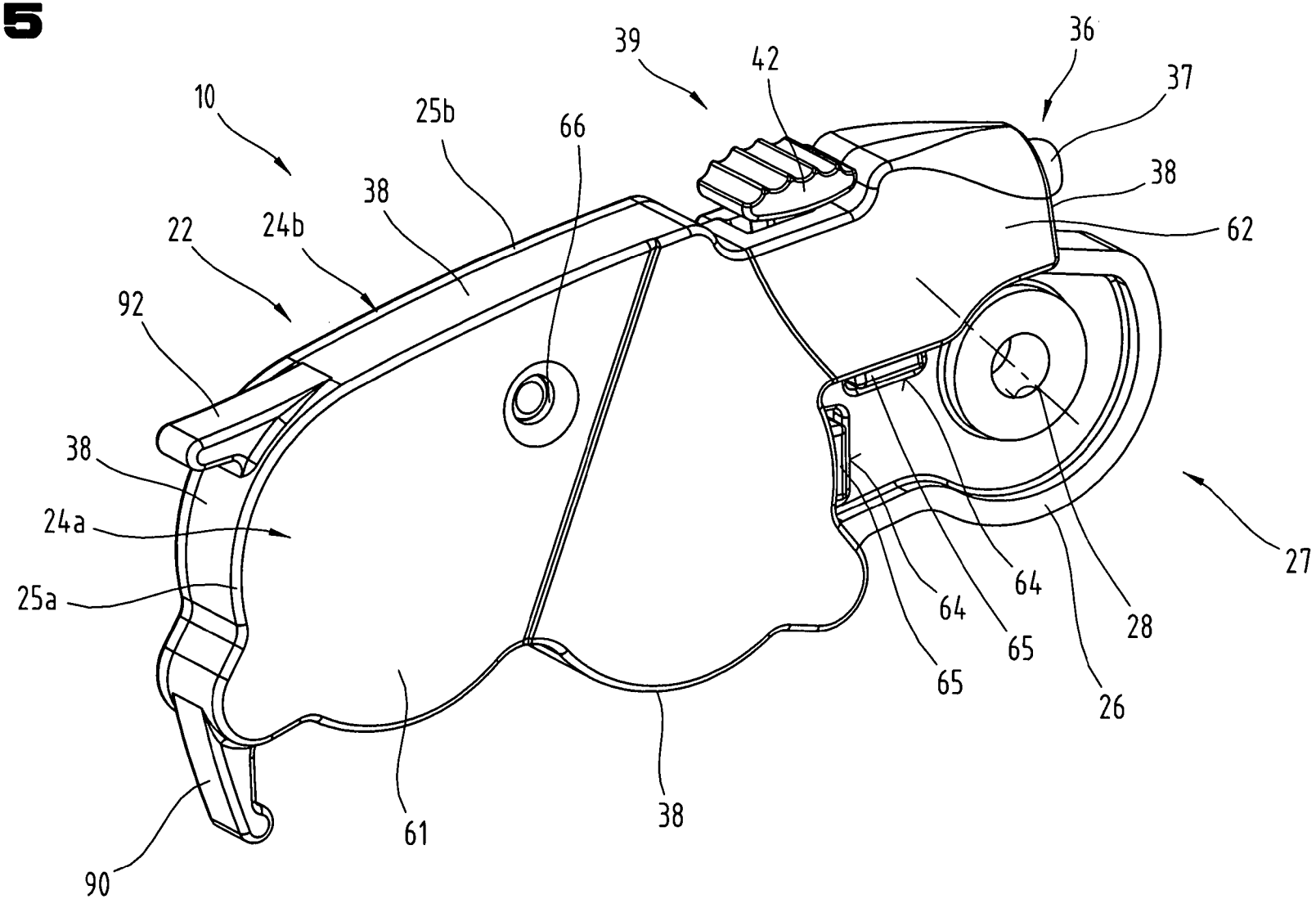
FIG. 5 is a simplified perspective of the displaceable implement and a housing case for the pocket tool proposed by the invention and illustrated in FIG. 1.

As also illustrated in FIGS. 2 and 5, implement 10 and housing case 22 and first and/or second housing part 24*a*, 24*b* has a stop nose 90 on the second slim face 38 lying opposite its pivot axis 15, which is supported against an abutment surface 91 in housing body 1 when implement 10 is in the stowed position. Implement 10 or housing case 22 or first and/or housing part 24*a*, 24*b* has a gripping piece 92 on its side-end second slim face 38 slightly protruding from housing body 2 when implement 10 is in the stowed position, gripping piece 92 being offset from stop nose 90.

FIGS. 11 to 19, which will be described together, illustrate different views of another embodiment of the pocket tool proposed by the invention. This pocket tool is a plate-shaped tool card 93 made from metal or plastic and has a rectangular contour with a width 94 and a length 95 as measured at a right angle thereto. Width 94 spaces two mutually parallel longitudinal side faces 96 apart from each other, extending at a right angle to transverse side faces 97 spaced apart from each other by length 95. Plate-shaped tool card 93 has a base plate 98 and a cover plate 99 extending substantially parallel to each other and joined to each other by means of a bonded seam or welded seam or a catch or snap-fit connection, between which a housing body 100 is formed. Oppositely lying internal side faces 101 bound at least certain regions of housing body 100 and several housing areas 102 which are separated from one another at least in certain regions are provided between the mutually facing side faces 101 and extend in a plane parallel to base and cover plates 98, 99, to accommodate a plurality of implements 10, which are accessible from the outside via housing openings 105. Implements 10 might be a knife 106, a nail file 107, a screwdriver 108 for screws of the standard type with a single slit, a screwdriver 109 for screws with cruciform slits, tweezers 110, and a tooth pick 111, for example. Each of these removable implements 10 has a handle piece 112, which projects into housing opening 105 when the respective implement 10 is in the stowed position.

Figure 12:
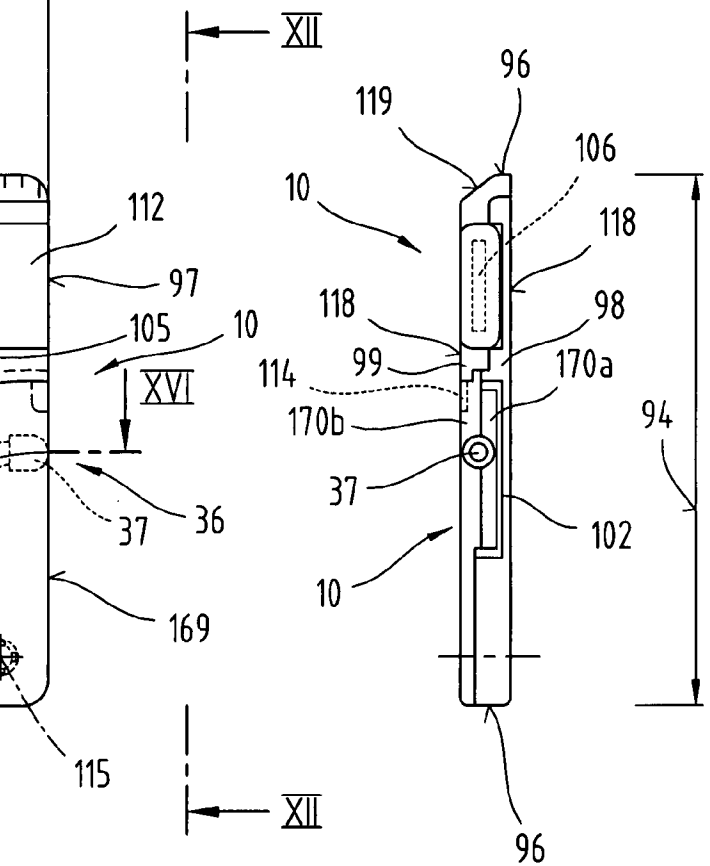
FIG. 12 is a simplified side view of the pocket tool illustrated in FIG. 11 along line XII—XII indicated in FIG. 11.

At least one of implements 10 is designed so that it can be pivoted out of the stowed position within housing area 102 into the operating position outside housing area 102 and has at least one power consumer 36, in particular a lighting means 37, at least one energy storage device 31 and a switch mechanism 39 and optionally an electronic circuit, which may be mounted on a board or on a film or may optionally accommodated in a single electronic component. This implement 10 has a housing case 113 to accommodate power consumer 36, energy storage devices 31, and switching mechanism 39 and optionally the electronic circuit if one is provided. Implement 10 or housing case 113 may be pivoted out about an axis 115 extending perpendicular to side faces 101 of base and cover plates 98, 99 from the stowed position illustrated in FIG. 11 into the operating position illustrated in FIG. 17 within an angular range of between approximately 0° and approximately 80°. Implement 10 can be locked in its stowed position by means of a catch or snap-fit mechanism 114 (FIG. 12). Implement 10 is disposed between housing case 113 and housing body 100. More specific details of the structure of implement 10 and its housing case 113 as well as the individual components will be given below with reference to FIGS. 16 and 18.

Figure 11:
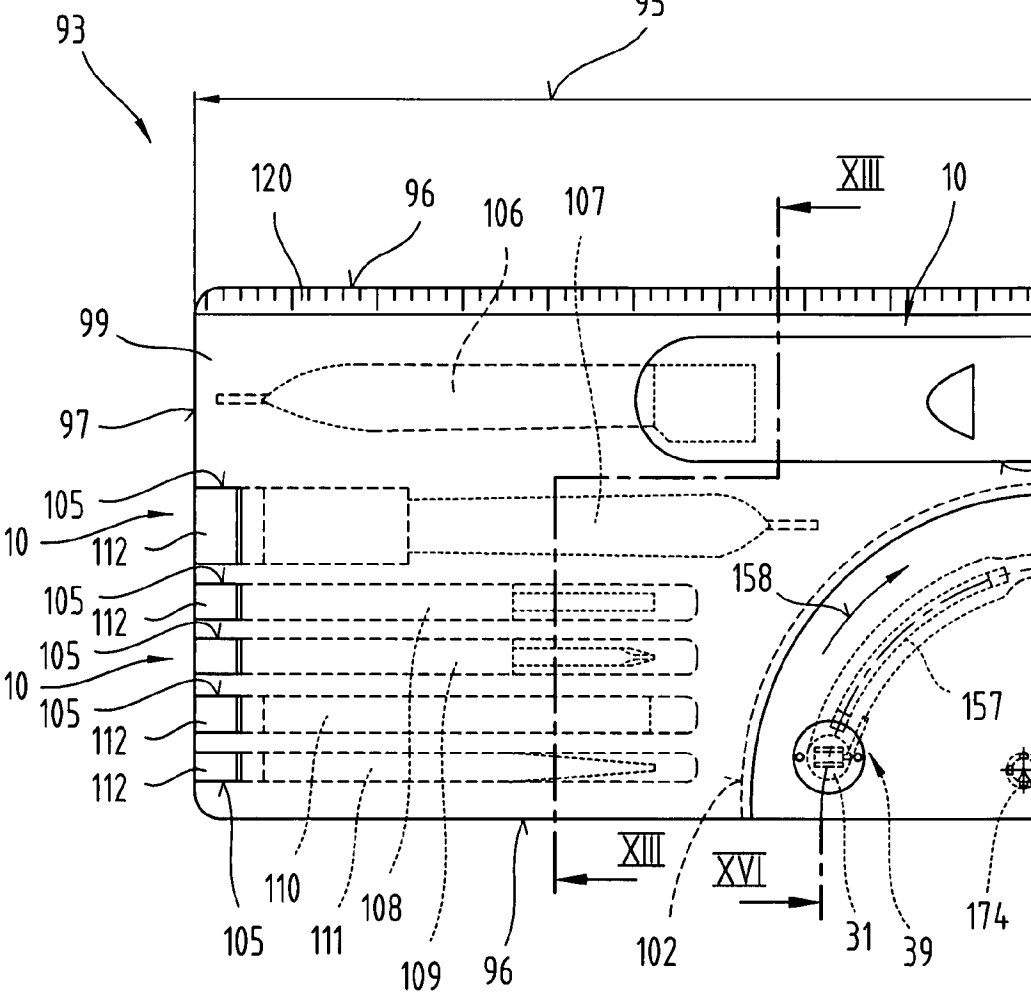
FIG. 11 is a highly simplified, schematic plan view of another embodiment of the pocket tool proposed by the invention with an implement pivoted into the stowed position inside the housing body.

As may be seen from FIGS. 11 and 12, one of longitudinal side faces 96 is joined to an external face 118 of cover plate 99 extending at a right angle to it by means of an oblique surface 119, extending at an angle from longitudinal side face 96 in the direction of external face 118 and is also provided with measuring indicia (e.g., a ruler) 120. Base plate 99 also constitutes an external face 118.

Figure 13:
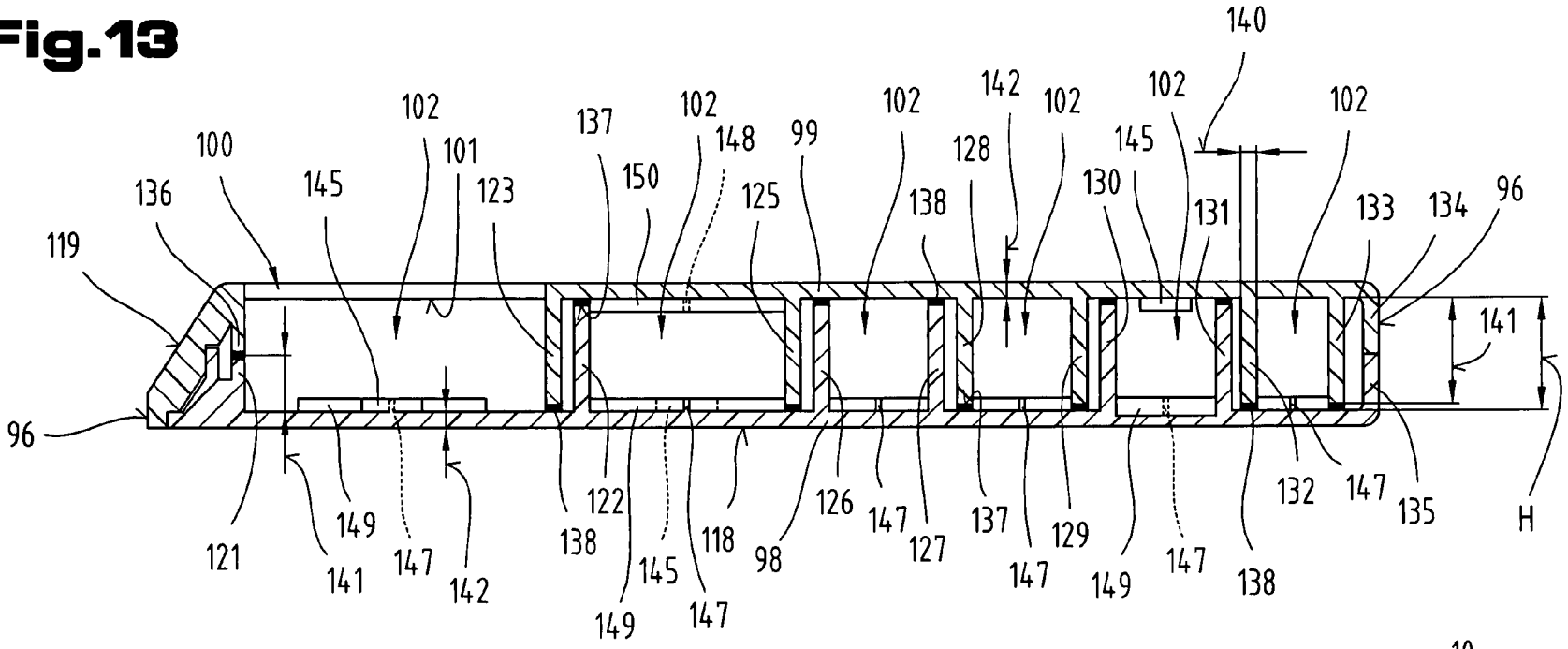
FIG. 13 is a simplified sectional view along line XIII—XIII of FIG. 11, on a very much enlarged scale, showing the pocket tool illustrated in FIG. 11.
Figure 19:
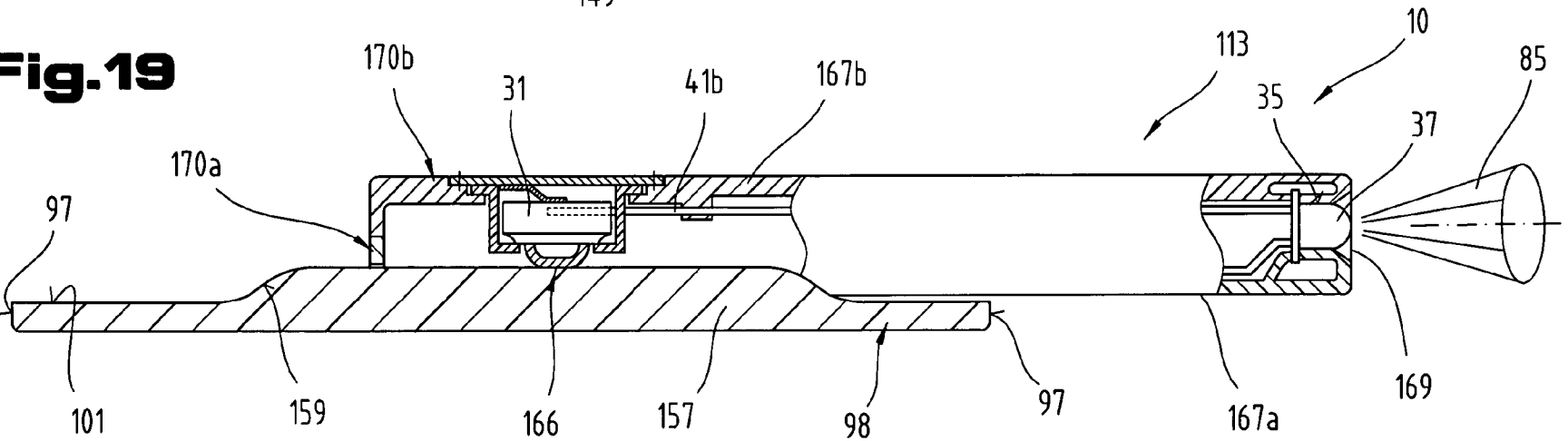
FIG. 19 is a highly simplified sectional view along line XIX—XIX of FIG. 17 showing the implement pivoted out into its operating position.
Figure 14:
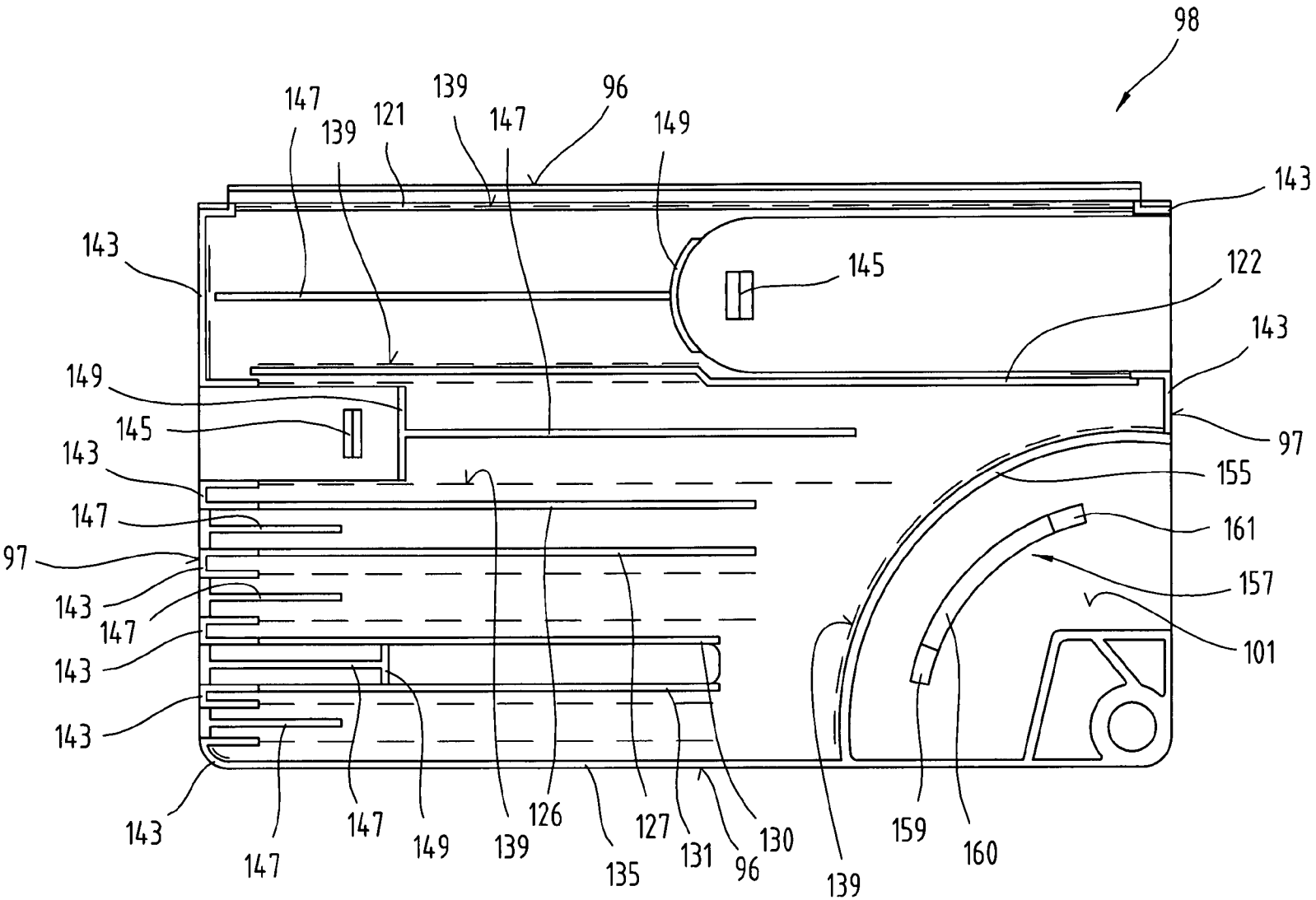
FIG. 14 is a simplified view of the internal side face of a base plate of the pocket tool illustrated in FIG. 11.
Figure 15:
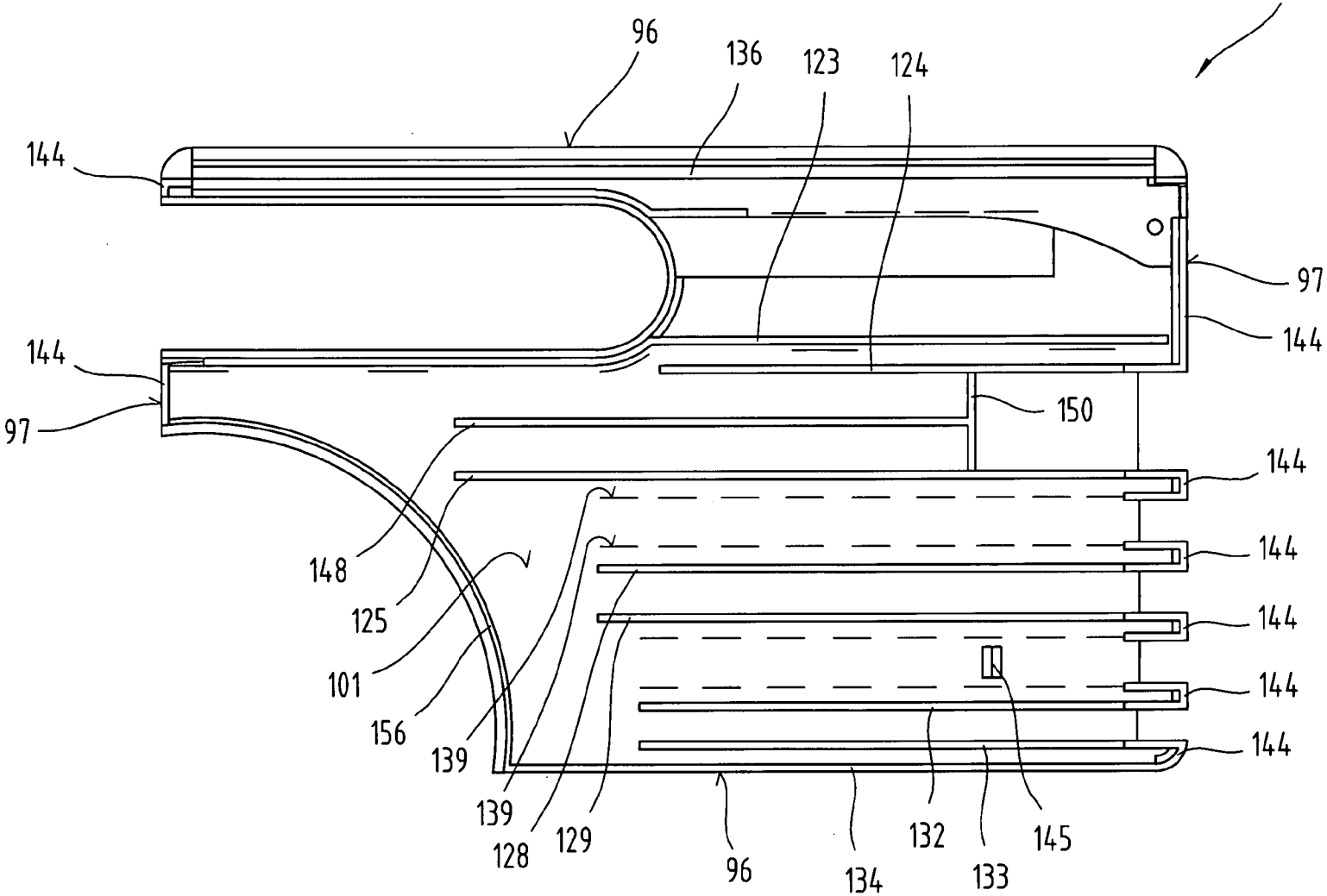
FIG. 15 is a simplified view of the internal side face of a cover plate of the pocket tool illustrated in FIG. 11.

FIGS. 13 to 15 illustrate one possible design of plate-shaped card tool 93. In this embodiment, several respective rib-like webs 121 to 136 are formed on side faces 101, distributed across the mutually facing side faces 101 of base and cover plates 98, 99, arranged parallel to one another and at least partially separated from one another. The webs 121 to 133, 136, which project out from base plate 98 towards cover plate 99 and out from cover plate 99 towards base plate 98 perpendicular to side faces 101, extend more or less across the entire internal height "H" between side faces 101 and bound at least certain regions of seating regions 102.

Distributed around internal faces 101, webs 121 to 136 keep the base and cover plates 98, 99 at a distance spaced apart from each other and form housing body 100 with housing areas 102 for implements 10 arranged therein. Webs 122 to 132 are arranged so that when cover plate 99 is placed on base plate 98, the two sit adjacent to each other. These webs 122 to 132 are joined by their respective terminal edges 137 to and facing side faces 101 of cover and base plates 98, 99 by means of a joining element 138, such as a bonded or weld seam. To this end, connecting webs 139 are provided on base and cover plates 98, 99 in the connecting regions between the terminal edge 137 of the respective web 122 to 133 and the side face 101 of the base or cover plate 98, 99 lying opposite it. These connecting webs 139 extend adjacent to webs 122 to 135 along the respective side face 101 of the base and/or cover plate 98, 99 or are arranged on at least one of the mutually facing terminal edges 137 of the respective webs 121, 136. By preference connecting webs 139 are spaced apart from one another in the longitudinal direction of webs 121 to 136—as illustrated by thin lines in FIGS. 14, 15—and have a slimmer width and height than the thickness 140 and height 141 of webs 121 to 136, the height and width being between approximately 0.01 mm and approximately 0.5 mm for example.

As may also be seen from FIG. 13, webs 121, 136 formed on base and cover plates 98, 99 may extend over only a part of the total internal height "H" between the mutually facing side faces 101, running towards one another, and when cover plate 99 is placed on base plate 98, the terminal edges 137 lie opposite one another and are joined to one another, preferably so that they cannot be detached, by means of joining element 138 (e.g., a bonded or weld seam). Accordingly, a continuous web 121, 136 is formed across the entire internal height "H" from base plate 98 to cover plate 99. In a preferred embodiment, height 141 of webs 121, 136 more or less corresponds to half of the total internal height "H". Connecting webs 139 or the adhesive applied thereto is/or are arranged directly on terminal edge 137 of web 121 and/or web 136 at points spaced apart from one another in the longitudinal direction, as may be seen from FIG. 14.

Parts of the material of connecting webs 139 and/or webs 121 to 133, 136 (and possibly webs 134 and 135 as well)) are fused by ultrasonic welding until the individual terminal edges 137 facing one another or the terminal edges 137 on the mutually opposite internal side faces 101 sit with their entire surfaces in abutment and base and cover plates 98, 99 are non-detachably joined to each other.

In order to make tool card 93 sufficiently resistant to bending even if rib-type webs 121 to 136 are of a thin-walled design, at least some of webs 121 to 133, 136 of base plate 98 and/or cover plate 99 extend more or less across the entire length 95 of tool card 93. By preference, a wall thickness 142 of base and cover plates 98, 99 essentially corresponds to thickness 140 of webs 121 to 136 and is between approximately 0.3 mm and approximately 2 mm, preferably, between approximately 0.5 mm and approximately 1.2 mm, for example approximately 0.8 mm.

As may also be seen from FIGS. 11, 14 and 15, peripheral webs 143, 144 bounding the seating openings 105 are provided in the peripheral region in the mutually opposite transverse side faces 97 of tool card 93, as illustrated in FIG. 11. These peripheral webs 143, 144 are formed onto side faces 101 of base plate 98 and/or cover plate 99 and project out from base plate 98 towards cover plate 99 and from cover plate 99 towards base plate 98 perpendicular to side faces 101. When cover plate 99 is placed on base plate 98, the respective oppositely lying peripheral webs 143, 144 on base plate 98 and/or cover plate 99 run towards one another and together form a continuous web from base plate 98 to cover plate 99. These peripheral webs 143, 144 abut with one another at their mutually facing terminal edges and need not necessarily be joined to one another by a joining element, in particular an adhesive or weld seam.

When implements 10, such as a knife 106, nail file 107, tweezers 110, toothpick 111, etc., are in their stowed positioned inserted in their respective housing area 102, they can be locked by means of a positive or non-positive connection between respective implement 10 and housing area 102, in particular webs 121 to 133, 136 and/or peripheral webs 143, 144 and/or side faces 101. To this end, at least one of side faces 101 of base plate 98 and/or cover plate 99 may be provided with a checking projection 145 in housing area 102 and implement 10, in particular gripping piece 112 has a complementary recess facing checking projection 145 so that implement 10 is locked in its stowed position due to the positive connection between checking projection 145 and the recess. Alternatively, implement 10 may be locked in seating region 102 by a non-positive connection. This is achieved by friction between gripping piece 113 of implement 10 and peripheral webs 143, 144 and/or side faces 101 for example.

As illustrated in FIGS. 14 and 15, guide webs 147, 148 are provided on base and cover plates 98, 99 extending in housing area 102 in the longitudinal direction of tool card 93, which project out perpendicularly from side faces 101 and extend across only a fraction of the entire internal height "H" between side faces 101. These guide webs 147, 148 prevent implement 10 from jamming or sticking as it is being pushed into housing area 102. Stop webs 149, 150 ensure that implements 10 are always held firmly in the same position when inserted in the stowed position. These stop webs are formed onto base plate 98 and/or cover plate 99, projecting in the perpendicular direction from side face 101 and, like guide webs 147, 148, extend across only a fraction of the total internal height "H" between side faces 101. Stop webs 149, 150 extend transversely to the direction in which implement 10 is inserted and are joined to the front end of guide web 147, 148 in the direction in which the implement is inserted.

As may also be seen from FIGS. 14 and 15, an arcuate web 155, 156 extends on the side face 101 of the base and cover plates 98, 99 extending in the vertical direction between longitudinal and transverse side faces 96, 97, running at a right angle to each other. Each of these webs extends more or less across the entire internal height "H" between side faces 101 or alternatively may extend across only a part of the internal height "H" and face one another. Arranged on side face 101 of base plate 98 transversely to web 155 and at a distance from it offset in the direction of axis 115 and parallel to or concentric with web 155 is an arcuately shaped control block 157. This control block 157 is preferably integrally formed on side face 101 and projects out towards cover plate 99 perpendicular to side face 101 and has an oblique ramp 159 at a front end in the displacement direction—indicated by arrow 158 in FIG. 11—and has a control surface 160 extending along the rest of its longitudinal extension parallel to side face 101.

In a preferred embodiment, the rear end of control block 157 also has an oblique ramp 161 at the rear end of control block 157—indicated by arrow 158 in FIG. 11. A height 164 of control block 157 perpendicular to side face 101 is dimensioned so that it or a part-section of oblique ramp 159, 161 and control surface 160 project partly or slightly out of an internal contour 165 of housing case 113 of pivotable implement 10 so as to cooperate with a positioning element 166, matching the contour of oblique ramp 159 and control surface 160. The height 164 corresponds at most to half the internal height "H" between side faces 101. Switch mechanism 39 is made up of control block 157 and positioning element 166. Control block 157 extends through an arcuately shaped longitudinal slot 168 in first side wall 167*a* adjacent to base plate 98.

Housing case 113 has two side walls 167*a*, 167*b* extending substantially parallel to side faces 101 at a distance from each other and slim faces 169 extending between side walls 167*a*, 167*b*. The first side wall 167*a* adjacent to base plate 98 is formed by a housing part 170*a* incorporating housing case 113 and second side wall 167*b* remote from base plate 98 is formed by a second housing part 170*b* incorporating housing case 113, the slim faces 169 being formed by the peripheral ridges extending vertically out from side walls 167*a*, 167*b* when housing parts 170*a*, 170*b* are placed one on top of the other. End faces 172, 173 of the peripheral ridges projecting out from first housing part 170*a* and second housing part 170*b*, respectively, are joined to each other by at least one joining element, such as a snap-fit or catch connection, screw connection, etc., although this is not illustrated, preferably so that they can be detached from each other. A compartment 35 for lighting means 37 is provided in housing case 113. This compartment 35 is formed respectively by half-shell-shaped recesses in first and second housing parts 170*a*, 170*b* in which part of lighting means 37 fits.

Housing case 113 of the pivotable implement 10 is in the shape of a segment of a circle and a bearing bore 174 is provided in the corner region concentric with axis 115. Lighting means 37 is disposed on the side-end first slim face 169 of housing case 113 remote from housing body 100 and seating region 102 in an eccentric position and offset from axis 115 in the radial direction. Slim faces 169 disposed at a right angle to each other and an arcuate slim face 169 extending between them bound housing case 113.

Energy storage device 31, for example, a battery, and positioning element 166 are arranged in front of control block 157 when the implement 10 is pivoted in its displacement direction—indicated by arrow 158—into the stowed position. When implement 10 is in the stowed position, positioning element 166 is in its initial position (see FIG. 16), whereas when implement 10 is in the operating position, positioning element 166 is in its operating position (see FIG. 19). In this embodiment, positioning element 166 cooperating with the negative terminal face is an electrically conductive switch contact 171 in the form of a resiliently elastic flexible tongue and is disposed on (and may be affixed to) first side wall 167*a* directly underneath energy storage device 31. At its free end, the flexible tongue has a small boat-shaped contact web 176, the longitudinal edge regions of which are angled. The longitudinal edge region of contact web 176 facing guide block 157 has an inclination which substantially matches the inclination of oblique ramp 159. This ensures that during movement of implement 10 as implement 10 is pivoted out from the retracted stowed position into the extracted operating position in the displacement direction—indicated by arrow 158—an upward sliding movement on oblique ramp 159 is assisted more or less in the direction perpendicular to side face 101 of contact web 176. The flexible tongue is made from an electrically conductive material or from plastic. The end of the flexible tongue attached to first side wall 167*a* is electrically connected to one of the two terminal wires 41*a*. The other terminal wire 41*b* is mounted by means of retaining projections 177 on second housing part 170*b* and its free end is run to a positive terminal face 179 of energy storage device 31, and is placed against it to provide an electrical connection. First terminal wire 41*a* is also mounted on first housing part 170*a* by means of retaining projections 177.

Figure 18:
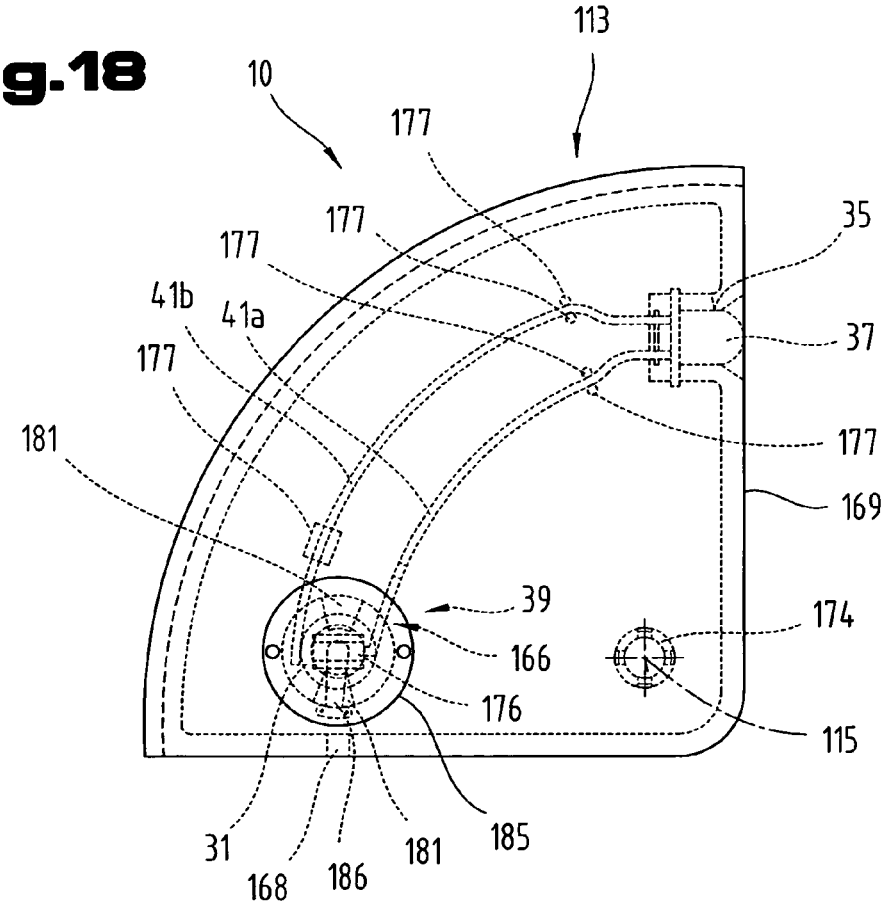
FIG. 18 is a highly simplified diagram showing a plan view of the housing case of the implement.

The at least one energy storage device 31 is replaceably arranged in a housing compartment 178. Housing compartment 178 has a circular section and an end-face flange 180 joined to it as well as at least two diametrically opposed bearing arms 181 attached to the free terminal end of the circular section. Bearing arms 181 engage round the battery on the negative terminal face 182 facing the flexible tongue. This housing compartment 178 which can be removed or taken out of implement 10 is supported by means of flange 180 in a recess 183 on second housing part 170*b*, in particular second side wall 167*b*. Housing compartment 178 is also closed off so as to be waterproof by means of a cover 185 also arranged inside a recess 184 of second side wall 167*b*. As schematically indicated in FIG. 18, cover 185 can be detachably connected to side wall 167*b* by means of screws. Naturally cover 185 could be attached to side wall 167*b* by a screw, snap-fit, or catch connection, etc.

Figure 16:
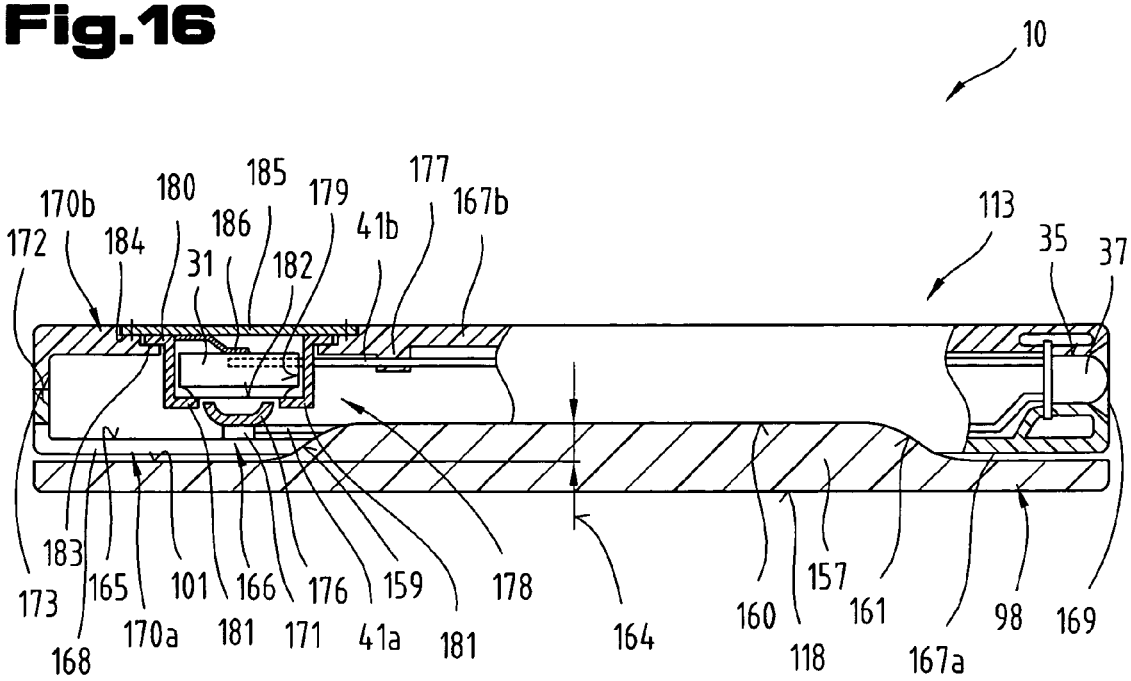
FIG. 16 is a highly simplified sectional view along line XVI—XVI of FIG. 11 showing the implement, pivotably mounted on the base plate.

As may also be seen from FIGS. 16 and 18, a spring element 186 is attached to an internal face on lid 185 facing the battery, by means of which the battery is pushed towards side face 101 in the vertical direction onto bearing arms 181. The biasing force of spring element 186 is set so that even when contact web 176 is pushed against the negative terminal face when implement 10 has been pivoted into its operating position, is higher than the opposing pressing force exerted by the flexible tongue, thereby ensuring that the battery sits firmly on bearing arms 181.

Figure 17:
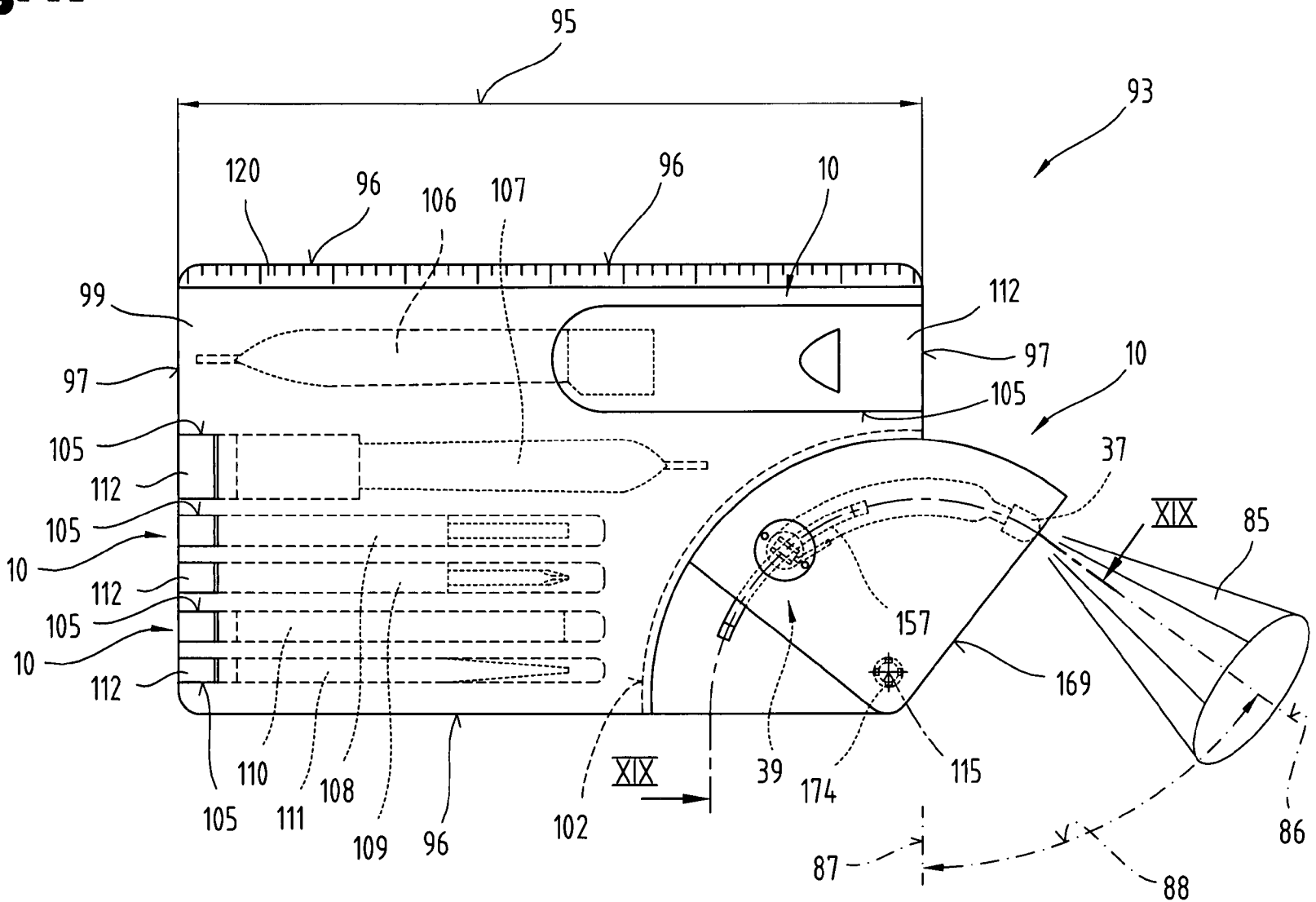
FIG. 17 shows the pocket tool of FIG. 11 with the implement pivoted out into its operating position.

In order to make the lighting means 37 ready for operation, implement 10 must be pivoted out of its stowed position inside housing area 102 illustrated in FIG. 11 into the operating position outside housing area 102 illustrated in FIG. 17. When the implement 10 is in the stowed position, positioning element 166 and switch contact 171 are in their initial position, as illustrated in FIG. 16. As implement 10 is moved in the displacement direction—indicated by arrow 158 in FIG. 11—from the stowed position into the operating position, positioning element 166 and switch contact 171 move closer to oblique ramp 159 during this movement and hit contact web 176 on oblique ramp 159 and slide along it. At the same time, contact web 176 is moved towards a negative terminal face 182 of the battery. On reaching a transition region between oblique ramp 159 and control surface 160, contact web 176 slides along control surface 160 extending parallel to side face 101 and from there on, positioning element 166 or switch contact 171 sits locked in its operating position while contact web 176 lies against negative terminal face 182 establishing an electrical connection. The electric circuit is therefore closed and lighting means 37 switched on, as illustrated in FIG. 17. As a result of the invention, an axis of symmetry 86 of beam 85 and plane 87 perpendicular to the longitudinal axis of tool card 93 subtend an angle 88, which can be adjusted as required between approximately 20° and approximately 90°.

Although not illustrated, an electronic circuit may be provided inside housing case 113. It may be provided on a board or on a film or optionally housed in a single electronic component. This electronic circuit incorporates a power consumer in the form of a display and/or input unit or a microprocessor microchip with a memory or electrical transmitter and/or receiver module and may also be supplied with the requisite voltage for operating lighting means 37. The display and/or input unit is expediently arranged on second side wall 167*b* remote from housing body 100 or inside side wall 167*b*.

Figure 20:
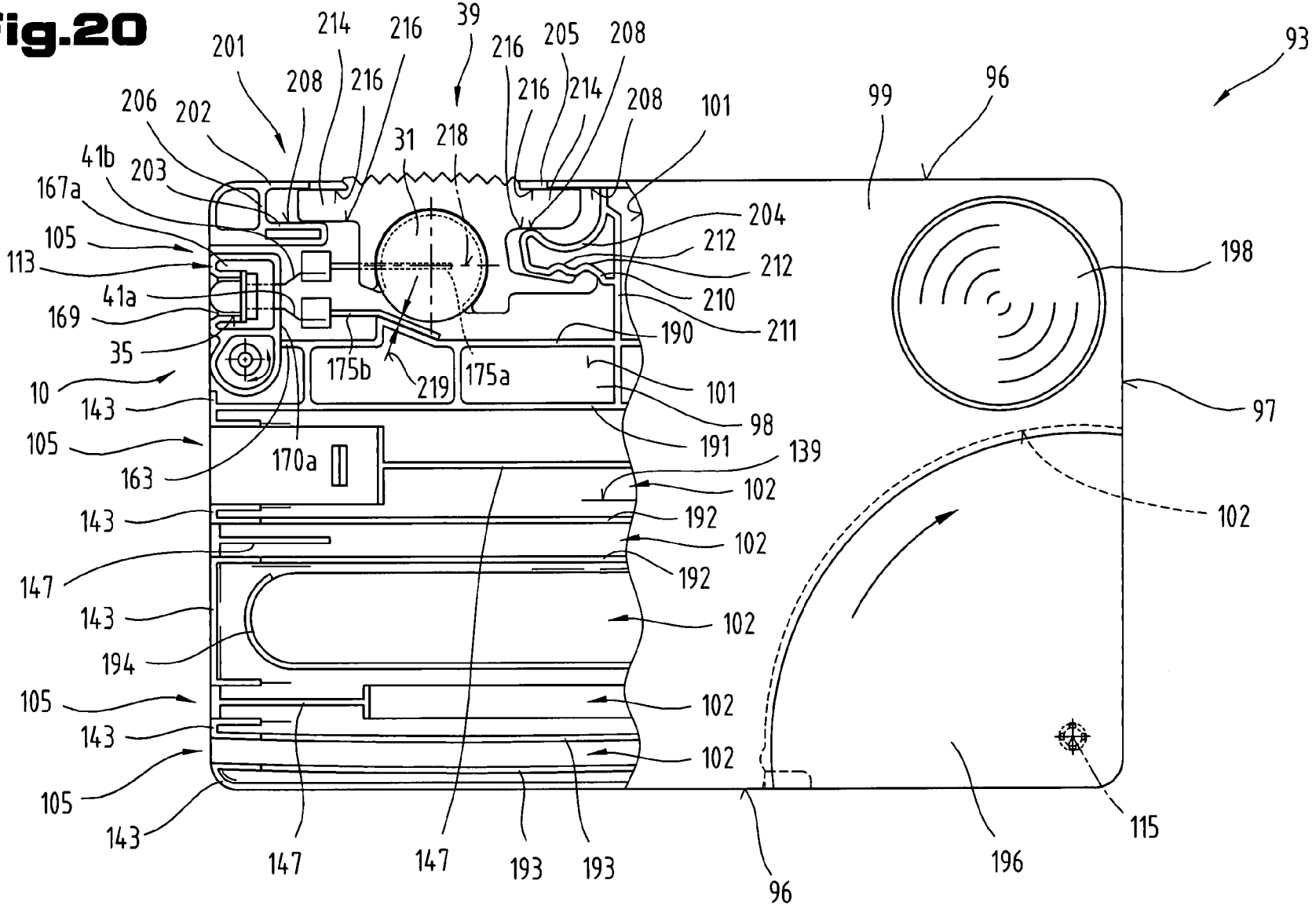
FIG. 20 is a highly simplified plan view of another embodiment of the pocket tool proposed by the invention, with the implement pivoted into the stowed position inside the housing body, viewed in partial section.
Figure 21:
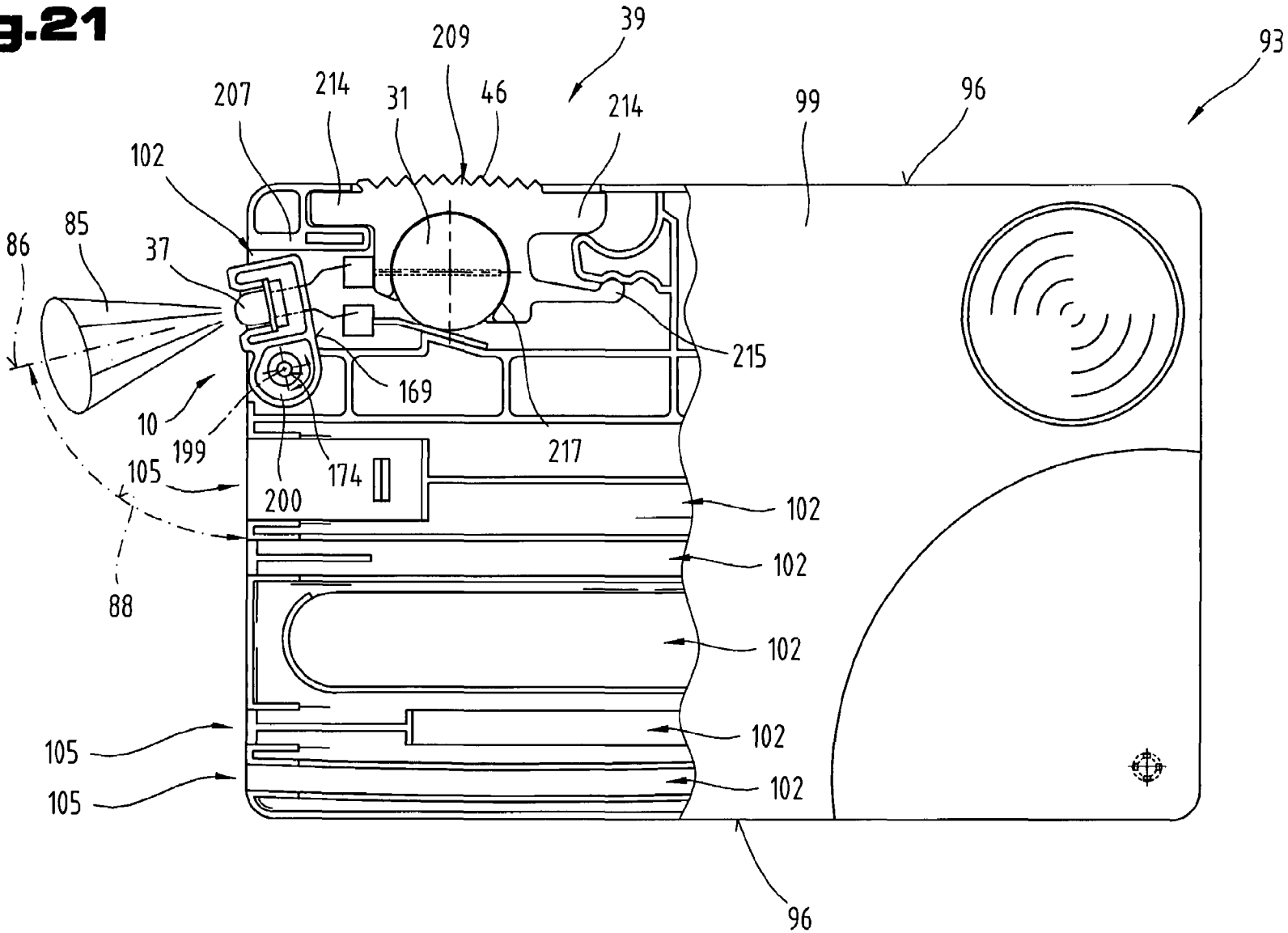
FIG. 21 depicts the pocket tool illustrated in FIG. 20 with the implement pivoted out into the operating position outside the housing body.

FIGS. 20 and 21, which will be described together, illustrate another embodiment of the pocket tool in the form of tool card 93. Plate-shaped tool card 93 has a base plate 98 and a cover plate 99 extending substantially parallel therewith, the two being joined to each other by an adhesive or weld seam or a catch or snap-fit connection so that they cannot be taken apart, between which a housing body 100 is formed. Between mutually facing side faces 101 of base and cover plates 98, 99, several webs 190 to 194 are provided in a plane extending parallel thereto, which are separated from one another in at least certain regions, forming housing areas 102 for a plurality of implements 10. In these drawings, however, only the displaceable implement 10 mounted between side faces 101 of base and cover plates 98, 99 is illustrated, whilst the other implements 10 which can be removed from tool card 93 are not shown.

The implements 10 designed to be taken out and used outside of housing areas 102 are accessible from outside housing body 100 via housing openings 105 and include a nail file, toothpick, pair of scissors, tweezers, and a ballpoint pen, for example. Displaceable implement 10 is also accessible from the outside by means of a housing opening 105.

As may also be seen from the drawings, a part of base plate 98 and/or cover plate 99 is mounted so that it can be displaced relative to at least one housing area 102 for the scissors. In a preferred embodiment, this displaceable part is provided in the form of a swivel plate 196 and is mounted so as to pivot about an axis 115 perpendicular to side faces 101 of base and cover plates 98, 99. When swivel plate 196 is pivoted—as indicated by the arrow—housing area 102 is accessible from outside and the scissors can be gripped by the scissor handles and taken out of housing area 102 for use. For more details of the layout of webs 191 to 194, peripheral webs 143, 144, guide webs 147, 148 and connecting webs 139 of base plate 98 and/or cover plate 99 and the layout of the removable implements 10, reference may be made to the teaching disclosed in document WO 97/19856 A.

Tool card 93 is also provided with a magnifying glass 198.

The at least one displaceable implement 10 is arranged between side faces 101 of base and cover plates 98,99 spaced apart from each other by the internal height "H" and is mounted so as to pivot about an axis 199 extending perpendicular to the side faces 101 of base and cover plates 98, 99 and incorporates housing case 113. Housing case 113 may be pivoted out of a stowed position inside housing area 102 (illustrated in FIG. 20) into an operating position outside the housing area 102 (illustrated in FIG. 21).

Housing case 113 has two housing parts 170*a*, 170*b*, which are preferably joined to each other so that they can be taken apart and in order to retain clarity in the drawings, the second housing part 170*b* has been removed from the first housing part 170*a*. Housing case 113 or housing parts 170*a*, 170*b* each form a side wall 167*a*, 167*b* extending parallel to side faces 101 of base and cover plates 98, 99, only first side wall 167*a* being visible in this instance. The slim faces 169 extend between these two side walls 167*a*, 167*b*, which are formed respectively by the peripheral ridges standing vertically out from the side walls 167*a*, 167*b* when housing parts 170*a*, 170*b* are placed one on top of the other. Compartment 35 for lighting means 37 is arranged in housing case 113, in particular the LED, lighting means 37 being only partly disposed inside housing case 113 and on the end-face first slim face 169 remote from housing body 100 or housing area 102.

First housing part 170*a* adjacent to base plate 98 has a pivot bearing region 200 in which a bearing bore 174 is provided for a pivot pin which extends through it.

The terminal contacts 41*a*, 41*b* or the terminal wires of lighting means 37 project out from the external contour of housing case 113, in particular on a side-end second slim face 169 facing housing area 102 and the free ends of the terminal wires are each electrically connected via a loop contact with two separate switch contacts 175*a*, 175*b*. Switch contacts 175*a*, 175*b* are affixed to side face 101 of base plate 98, each having a loop contact surface and a conductor bar projecting out from it, with the free end of the respective terminal wires lying on the loop contact surface.

The pivotably mounted implement 10 incorporating lighting means 37 is mounted so as to be pivotable in housing area 102 of housing body 100. A guide mechanism 201 for operating element 42 incorporating switch mechanism 39 is provided in this housing area 102.

Guide mechanism 201 is provided in the form of lateral guide webs 202 to 204. The outer lateral guide web adjacent to longitudinal side face 96 extends parallel to longitudinal side face 96 and has an oblong slot 205. The inner lateral guide web 203 is disposed at a vertical distance from longitudinal side face 96 and parallel to outer lateral guide web 202. Outer lateral guide web 202 is joined to inner lateral guide web 203 by means of a transverse web 206. Transverse web 206 is adjoined by a compartment web 207. Lateral guide web 204 is disposed in an end region of guide mechanism 201 remote from implement 10. Outer lateral guide web 202, inner lateral guide web 203, and lateral guide web 204 which has an arcuately shaped part-section have mutually facing guide surfaces 208, between which operating element 42 of switch mechanism 39 for implement 10 (e.g., lighting means 37) is mounted so as to slide in the longitudinal direction of tool card 93. Operating element 42 is provided in the form of a slide 209 in this embodiment.

The arcuately shaped lateral guide web 204 is adjoined by a locking web 210, which is joined to web 190 at one end by another transverse web 211. This locking web 210 has one or more lock recesses 212, which are convex in shape in the direction towards longitudinal side face 96.

Switch mechanism 39 comprises operating element 42 or slide 209 with gripping piece 46 which may or may not project slightly beyond the external contour of card tool 93. Slide has two guide extensions 214 extending in opposite directions from each other and a housing compartment 217 for the energy storage device 31, in particular a battery, as well as a locking projection 215 which is elastically resilient in the direction substantially perpendicular to the direction in which slide 209 is displaced. Guide extensions 214 are each bounded by guide surfaces 216 spaced apart from each other by a guide width. The guide width is slightly shorter than the distance between the mutually facing guide surfaces 208 of lateral guide webs 202 to 204. Housing compartment 217 for the battery is provided in the form of a bore in slide 209 and has inside it a mounting flange—indicated by broken lines—on which the battery is partly supported. However, the battery is placed in the housing compartment 217 so that a reliable contact is always established between it and the first switch contact 175*a*. As may be seen from FIG. 20, a stop web 163 is provided on base plate 98 and/or cover plate 99, against which implement 10 or housing case 113 is positioned in the retracted stowed position.

As explained above, switch contacts 175*a*, 175*b* are provided for implement 10 on side face 101 inside housing area 102, and may be glued. The first switch contact 175*a*, in particular the conductor bar, extends parallel to longitudinal side face 96 and preferably along a mid-axis 218 of the battery. While guide surfaces 208 of guide mechanism 201 provide a lateral guiding action for slide 209 of switching mechanism 39, first switch contact 175*a*, in particular the conductor bar, constitutes a guide surface in the height direction and simultaneously acts as a contact surface for the negative terminal face of the battery. Naturally, slide 209 could also be guided by guide surfaces 208 and side faces 101, in which case at least first contact 175*a* will be recessed in side face 101 of base plate 98. Second switch contact 175*b*, in particular the conductor bar, extends at an angle to longitudinal side face 96 or mid-axis 218 of the battery so that when switch mechanism 39 is in the non-operating switch position, second switch contact 175*b* and a circular external surface of the battery constituting the positive terminal face are spaced at a distance 219 apart. When switch mechanism 39 together with the battery is pushed in the direction towards implement 10 or lighting means 37, guide surfaces 216 of the slide 209 slide along guide surfaces 208 of lateral guide webs 202 to 204. Locking projection 215 is simultaneously moved out of a first lock recess 212 as slide 209 is pushed, so that the negative terminal face of the battery extending parallel to side face 101 slides along the contact face of first switch contact 175*a* facing it, in particular the conductor bar. Once the positive terminal face oriented perpendicular to side face 101 reaches second switch contact 175*b*, the electric circuit is closed and lighting means 37 is in operation. Locking projection 215 simultaneously latches into the other lock recess 212, thereby preventing slide 209 from shifting of its own accord.

Before operating switch mechanism 39, implement 10 can be pivoted out of the stowed position (see FIG. 20) into the operating position (see FIG. 21), in which a working surface can be optimally illuminated by making any desired adjustment of angle 88 or lighting means 37 replaced if spent. Consequently, lighting means 37 can be switched on by operating switch mechanism 39 both when implement 10 is in the retracted stowed position and when implement 10 is in the extracted operating position.

Although not illustrated, another option is to provide an electronic circuit inside housing body 100, in particular in housing area 102 for the displaceable implement 10. This may be disposed on a board or on a film or alternatively may be housed in a single electronic component. This electronic circuit incorporates one or more electrical power consumers in the form of a display and/or input unit or a microprocessor or a microchip with a memory or an electrical transmitter and/or receiver module and may be provided with the requisite voltage for supplying the lighting means 37. The electronic circuit may therefore be supplied with voltage by means of the energy storage device 31 of switch mechanism 39 or by an additional energy storage device, for example a battery, solar cell, not illustrated, provided in housing body 100.

Figure 23:
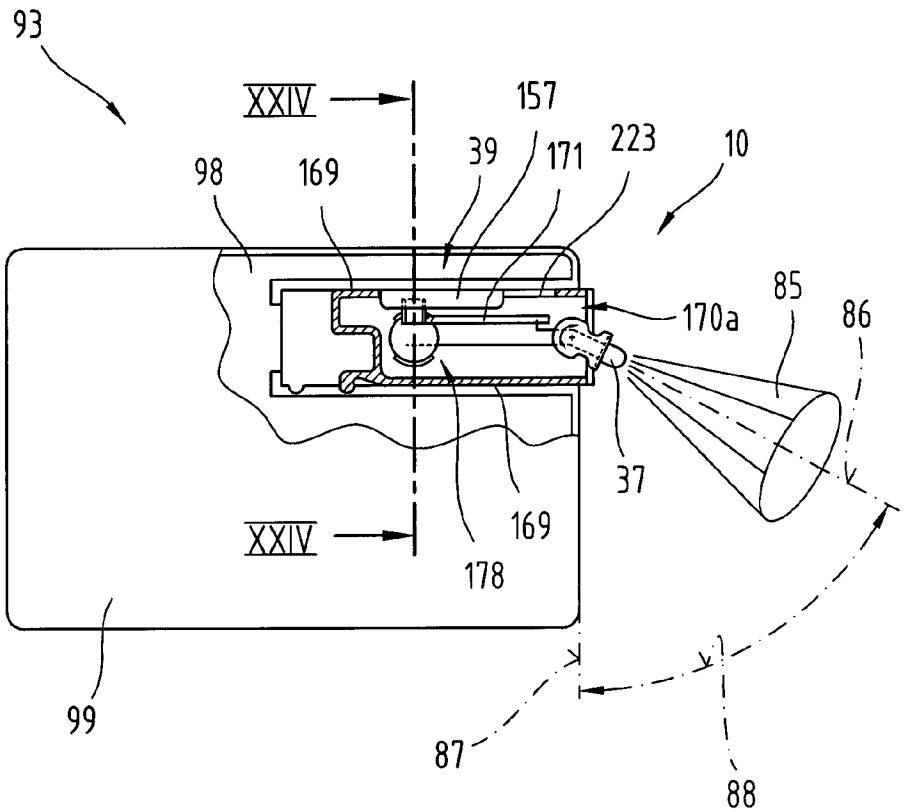
FIG. 23 depicts the pocket tool illustrated in FIG. 22 with the implement extracted into the operating position outside the housing body.
Figure 24:
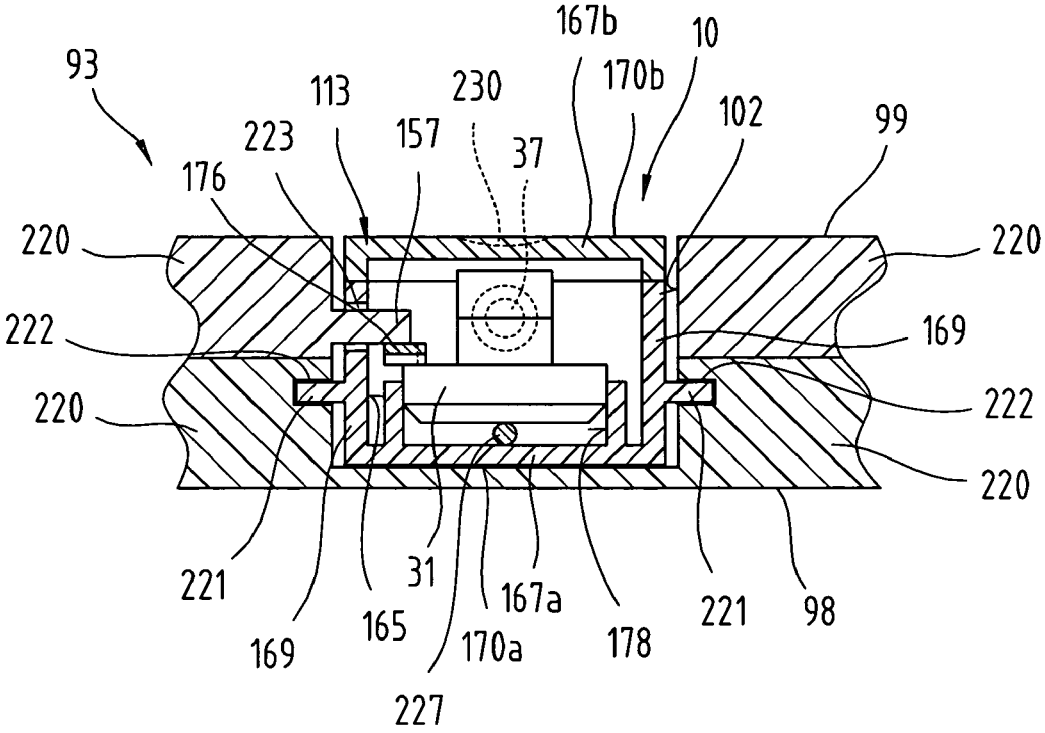
FIG. 24 is a sectional view through the implement, along line XXIV—XXIV of FIG. 23.
Figure 25:
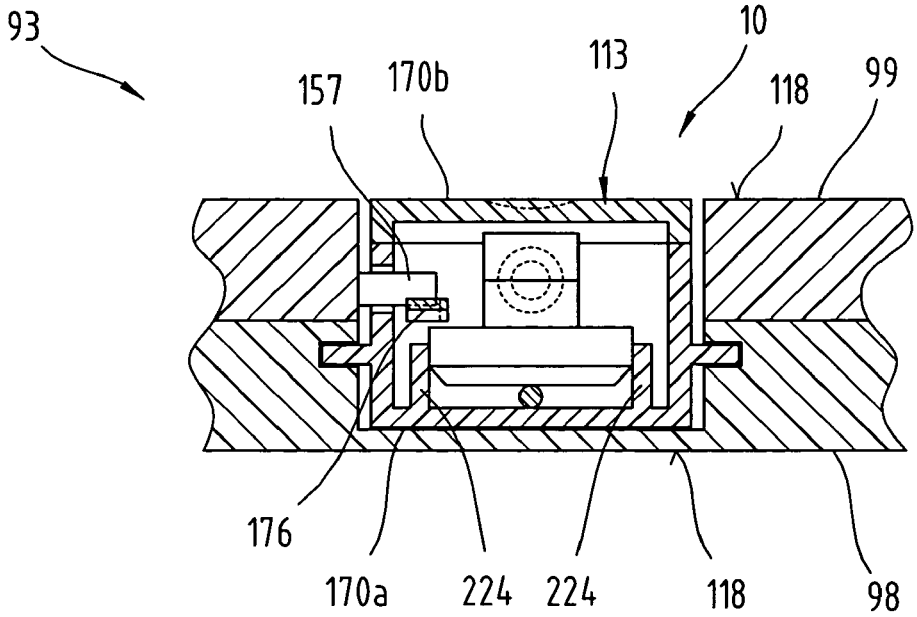
FIG. 25 is sectional view through the implement, along line XXV—XXV of FIG. 22.

FIGS. 22 to 25, which will be described together, illustrate another embodiment of tool card 93. The plate-shaped tool card 93 consists of base plate 98 and cover plate 99 extending essentially parallel to it, the two preferably being joined to each other so that they cannot be taken apart, and between which a housing body 100 is formed. Mutually opposite side faces 101 bound at least certain regions of housing body 100 and several housing areas 102 at least partially separated from one another extend between the mutually facing side faces 101 in a plane parallel to base and cover plates 98, 99 for a plurality of implements 10, as described in detail above in connection with the preceding drawings and therefore not explained in further detail in connection with these drawings. As illustrated in these drawings, at least one of these implements 10, is mounted so that it can be displaced from the stowed position inside housing area 102 into the operating position outside housing area 102. At least certain regions of housing area 102 for this displaceable implement 10 are bounded by webs 220, which are formed onto the side face 101 of base and cover plates 98, 99 and project vertically out from base plate 98 towards cover plate 99 and out from cover plate 99 towards base plate 98 perpendicular to side faces 101, extending respectively across half the internal height "H" between side faces 101 of base and cover plates 98, 99. The respective mutually opposite webs 220 of base and cover plates 98, 99 extend towards one another when cover plate 99 is placed on base plate 98, as illustrated in FIGS. 24, 25, and together form a continuous web from base plate 98 to cover plate 99.

The displaceable implement 10 has a housing case 113 with side walls 167*a*, 167*b* extending opposite and at a distance from each other substantially parallel to side faces 101 and slim faces 169 extending between side walls 167*a*, 167*b*. Side walls 167*a*, 167*b* are formed by first housing part 170*a* adjacent to base plate 98 and second side wall 167*b* is formed by second housing part 170*b* adjacent to cover plate 99 and slim faces 169 respectively by peripheral ridges projecting vertically out from side wall 167*a*, 167*b* when housing parts 170*a*, 170*b* are placed one on top of the other, housing part 170*b* and side wall 167*b* being left out of FIGS. 22 and 23 in order to retain clarity.

The implement 10 or housing case 113 is mounted so as to slide inside housing area 102 parallel to the longitudinal axis of tool card 93. To this end, a guide mechanism is provided between the mutually opposite webs 220 and housing case 113, in particular first housing part 170*a*. The guide mechanism has two mutually opposite guide rails 221 on parallel slim faces 169 projecting vertically out from the first side wall and guide grooves 222 complementing webs 220. Guide rails 221 extend parallel to each other and parallel to side faces 101 of base and cover plates 98, 99 and project beyond the external contour of housing case 113.

One of webs 220 of base and/or cover plates 98, 99 at least partially bounding housing area 102 has a control block 157 projecting out from the internal contour 165 of housing case 113. Control block 157 extends through an oblong slot 223 in housing case 113, in particular in first housing part 170*a*, extending parallel to side faces 101. As explained above, control block 157 may be designed so that the front end in the displacement direction—indicated by arrow 158—has oblique ramp 159, not illustrated, to enable contact web 176 to slide along the electrically conductive flexible tongue forming positioning element 166 without the need to apply a strong force. Switch mechanism 39 consists of positioning element 166 and control block 157.

Figure 22:
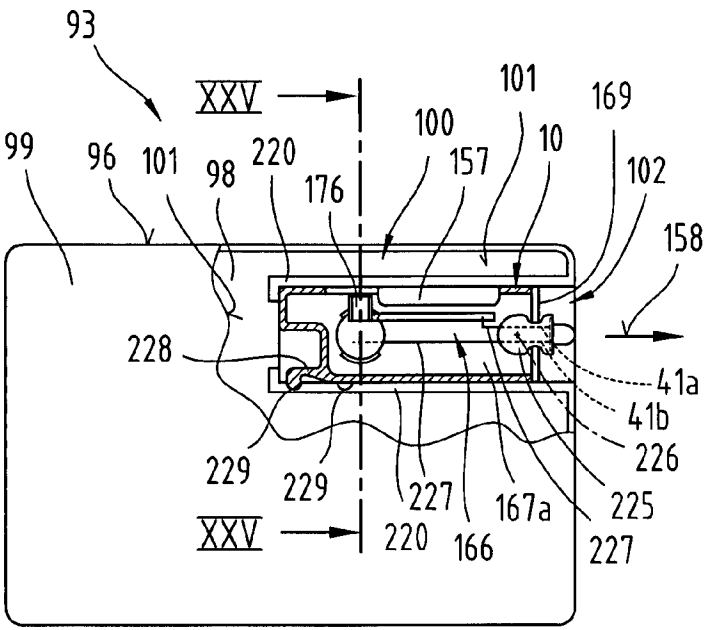
FIG. 22 is a schematic plan view of another embodiment of the pocket tool proposed by the invention with the implement retracted into the stowed position inside the housing body.

As may be seen more clearly in FIGS. 24 and 25, housing case 113, in particular first housing part 170*a*, has a housing compartment 178 for energy storage device 31, such as a battery, on first side wall 167*a*. This includes two diametrically opposite shell-shaped housing segments 224, by means of which the battery is laterally guided. Housing compartment 178 with energy storage device 31 is positioned at the rear end in the displacement direction—indicated by arrow 158—whereas lighting means 37 is disposed at the front end in the displacement direction—indicated by arrow 158—on the side-end first slim face 169 of housing case 113. Lighting means 37 is arranged inside a lighting means housing 225, mounted so that it can be pivoted about an axis 226 perpendicular to side faces 101 on or in implement 10, in particular housing case 113 as shown in FIGS. 22 and 23.

This lighting means housing 225 consists of two shells, each having a half-shell-shaped recess to accommodate certain regions of lighting means 37, in particular a LED. The free ends of terminal contacts 41*a*, 41*b* of lighting means 37 are electrically connected via a plug connection, not illustrated, to connecting lines 227.

The first connecting line 227 is connected to the electrically conductive first switch contact 171. The second connecting line 227 sits on a negative terminal face of the battery extending parallel to side faces 101 and therefore establishes an electrical connection with the battery. Connecting lines 227 may be provided in the form of a film-type conductor track or by hard wiring. In another possible design, housing compartment 178 for the battery and also connecting lines 227 and positioning element 166 may be arranged on a board, which can be fixed inside housing case 113.

The battery is located underneath contact web 176 so that when implement 10 is moved in a displacement direction—as indicated by arrow 158—from the stowed position (illustrated in FIG. 22) into the operating position (illustrated in FIG. 23) contact web 176 moves in a direction towards control block 157, optionally on oblique ramp 159, and sits against the latter and, as a result of continued displacement downwards in the direction of the positive terminal face of the battery—as indicated by 158—is brought into contact with it, thereby closing the electric switch circuit, illuminating lighting means 37. Once the implement 10 has been moved into its operating position, the inclination of lighting means housing 225 and angle 88 between axis of symmetry 86 of beam 85 (typically a conical beam) and plane 87 oriented perpendicular to the longitudinal axis of card tool 93 can be adjusted as required. Angle 88 may be freely adjusted between approximately 10° and approximately 170°. Accordingly, the beam can be projected onto a desired working surface, irrespective of the position of card tool 93, and the angle of incidence of beam 85 varied.

Second housing part 170*b* is detachably connected to first housing part 170*a* by means of a snap-fit or catch mechanism, not illustrated. As may also be seen from FIGS. 22 and 23, at the end region remote from lighting means 37 and disposed on one of slim faces 169 parallel to longitudinal side face 96, housing case 113 has a resiliently elastic locking projection 228, which is able to latch alternately in a positive connection into one of two lock recesses 229 arranged at a distance apart from each other in the displacement direction—indicated by arrow 158—of a shape complementing that of the locking projection. Lock recesses 229 are provided on web 220 of base plate 98 and/or cover plate 99 lying opposite control block 157.

Since implement 10, in particular housing case 113, is locked in the retracted stowed position and the extracted operating position, implement 10 is prevented from vibrating and implement 10 is reliably prevented from moving of its own accord out of the operating position into the stowed position, for example. In order to make the implement 10 convenient to operate, a freely accessible gripping depression 230 (FIG. 24) is provided in the external face of housing case 113, such as second housing part 170*b*.

In the embodiments described above, positioning element 166 is electrically conductive and a first terminal contact of power consumer 36 is connected to it, either directly or with a connecting line 227 connected in between. In another embodiment, which is not illustrated, switch mechanism 39 consists of control block 157 and positioning element 166. Control block 157 is formed onto at least one web 155, 220 bounding at least certain regions of housing area 102 for the displaceable implement 10 and has an oblique ramp 161 at a front end of control block 157 in the direction in which the implement 10 is displaced, with a control surface 160 adjoining it. Oblique ramp 161 and control surface 160 are oriented perpendicular to side faces 101 of base and cover plates 98, 99. Control block 157, in particular oblique ramp 161 and control surface 160, project out from the internal contour 165, at slim face 169 of housing case 113 facing control block 157 when implement 10 is pivoted out and is able to cooperate with positioning element 166, conforming to the contour of oblique ramp 159 and control surface 160. To this end, slim face 169 of housing case 113 is provided with an oblong slot 168, 223 extending parallel to side faces 101 of base and cover plates 98, 99. Housing case 113 comprises first and second housing parts 170*a*, 170*b* with two side walls 167*a*, 167*b* extending parallel to side faces 101 of base and cover plates 98, 99 and slim faces 168 extending between them. Slim faces 169 are formed by peripheral ridges projecting vertically out from side walls 167*a*, 167*b* when housing parts 170*a*, 170*b* are placed one on top of the other. The at least one energy storage device 31 and the at least one lighting means 37 are disposed inside housing case 113.

Positioning element 166 is provided in the form of an arcuately curved flexible arm and has a guide mechanism with at least two guide webs 58*a*, 58*b* spaced apart from each other, between which a first switch contact 41*a*, in particular the terminal contact of lighting means 47, is guided. The guide mechanism is preferably arranged on a side face of the flexible arm extending parallel to side faces 101 of base and cover plates 98, 99. The flexible arm may be formed onto the peripheral edge of first housing part 170*a* and/or second housing part 170*b* of housing case 113 facing control block 157 and the free end of the flexible arm preferably tapers and is slimmer in thickness. A free end of switch contact 41*a* projects slightly beyond the free upstanding end of the flexible arm. Second switch contact 41*b*, in particular the terminal contact of lighting means 47, is electrically connected to the negative terminal surface of the battery, for example.

As implement 10 is displaced between the stowed position and operating position, the flexible arm, which is made from a non-conducting material, such as plastic for example, is moved by control block 157 between an initial stowed position and an operating position. When implement 10 is displaced from the stowed position into the operating position, the free end of the flexible arm slides along control block 157 so that the free end of first switch contact 41*a* is simultaneously moved in the direction towards the positive terminal face of the battery. As soon as the free end of the resilient arm sits against control surface 160, the free end of first switch contact 41*a* establishes a contact with the positive terminal face of the battery.

Positioning element 166 and first switch contact 41*a* or terminal contact are coupled in displacement by means of the guide mechanism so that when positioning element 166 is in the initial position, first switch contact 41*a* is spaced apart from the positive terminal face of the battery and is electrically isolated and when positioning element 166 is in the operating position, first switch contact 41*a* sits against the positive terminal face of the battery so that lighting means 37 is switched on. Positioning element 166 is located in the initial position when implement 10 is moved into its stowed position and into its operating position when implement 10 is moved into its operating position. Lighting means 37 is again disposed on the side-end first slim face 169 of housing case 113 remote from housing area 102 and angle 88 preferably is freely adjustable, as explained at length above.

In another embodiment, not illustrated, implement 10 illustrated in FIGS. 11 to 25 incorporates a switch mechanism with an operating element, at least one energy storage device and at least one lighting means. Lighting means is operated by means of operating element. Operating element projects out from the external contour, in particular from the freely accessible side wall of housing case and is provided in the form of a switch or push button. This design of switch mechanism with operating element and at least one energy storage device and at least one lighting means, is already known from the prior art and is illustrated in detail in FIGS. 19 to 22 of patent specification WO 99/07247 A filed by the present applicant and is included by reference in this application.

Finally, it should be pointed out that tool card 93 illustrated in FIGS. 11 to 19 may also be provided with the displaceable implement 10 or housing case 22. This being the case, housing case 22 is mounted so as to pivot about axis 115 between side faces 101 of base and cover plates 98, 99. Another advantage is the fact that at least one energy storage device 31 and lighting means 37 are arranged in a plane extending parallel to side faces 6; 101 of the housing body 2; 100, which results in a narrow construction width of the implement 10. Naturally, it would also be possible for only one of housing parts 24*a*, 24*b*; 170*a*, 170*b* to be provided with the peripheral ridge forming slim faces 38; 169 projecting out perpendicular to side wall 25*a*, 25*b*; 167*a*, 167*b*, in which case the oppositely lying housing part 24*a*, 24*b*; 170*a*, 170*b* will be of an essentially flat design. The implement 10 illustrated in FIGS. 1 to 10 has housing case 22, consisting of two oppositely lying side faces extending parallel to side walls 5 and a peripheral-face slim face 38 extending in the transverse direction between the side faces of implement 10. The power consumer 36 to be inserted in seating 35 between housing case 22 and a cover is positioned off-center from bearing bore 28 on slim face 38 extending between the mutually opposite side faces 34 of housing case 22. Compartment 35 is open to the exterior at an end face on slim face 38 and power consumer 36, such as the lighting means, extends slightly from slim face 38. The slim face 38 is made up of the peripheral ridges 26, 63.

For the sake of good order, it should finally be pointed out that in order to provide a clearer understanding of the design of the pocket tool, it and its constituent parts are illustrated to a certain extent out of proportion and/or on an enlarged scale and/or on a smaller scale.

The underlying objective and the independent solutions proposed by the invention may be found in the description.

Above all, the individual embodiments of the subject matter illustrated in FIGS. 1 to 25 constitute independent solutions proposed by the invention in their own right. The associated objectives and solutions proposed by the invention may be found in the detailed descriptions of these drawings.

LIST OF REFERENCE NUMBERS

1 Pocket knife
2 Housing body
3 Width
4 Length
5 Side wall
6 Side face
7 Cover plate
8 Dividing wall
9 Housing area
10 Implement
11 End region
12 End region
13 Rivet
14 Rivet
15 Axis
16 Screwdriver
17 Bit holder
18 Knife blade
19 Screwdriver
20*a* Knife blade
20*b* Knife blade
21 Knife blade
22 Housing case
23 Input and display unit
24*a* Housing part
24*b* Housing part
25*a* Side wall
25*b* Side wall
26 Peripheral ridge
27 Pivot-bearing region
28 Bearing bore
29 Positioning projection
30 Compartment
31 Energy storage device
32 Part-section
33 Support face
34 Support face
35 Compartment
36 Power consumer
37 Lighting means
38 Slim face
39 Switch mechanism
40 Retaining arm
41*a* Switch contact
41*b* Switch contact
42 Operating element
43 Opening
44 Displacement path
45 Stop surface
46 Gripping piece
47 Terminal end
48 Switch block
49 Bearing surface
50 Terminal end
51 Guide block
52 Length
53 Rocker arm section
54 Flexible arm section
55 Spacing web
56 Side face
58*a* Main dimension
58*b* Guide web
59 Guide web
60 Catch recess
61 Catch nose
62 Housing part-section
63 Housing part-section
64 Peripheral ridge
65 Recess
66 Catch or snap-fit element
66 Pin
67 Bore
68 Contact bridge
69 Orifice
71 Compartment

75 Slim face
76 Slim face
77 Pivot angle
78 Hook
79 Support surface
80 Angular position
81 Working surface
82 Eye
83 Ring
84 Adjustment angle
85 Conical beam
86 Axis of symmetry
87 Plane
88 Angle
90 Stop nose
91 Abutment surface
92 Gripping piece
93 Tool card
94 Width
95 Length
96 Longitudinal side face
97 Transverse side face
98 Base plate
99 Cover plate
100 Housing body
101 Side face
102 Housing area
105 Housing opening
106 Knife
107 File
108 Screwdriver
109 Screwdriver
110 Tweezers
111 Toothpick
112 Gripping piece
113 Housing case
114 Catch or snap-fit mechanism
115 Axis
118 External face
119 Oblique surface
120 Rule
121 Web
122 Web
123 Web
124 Web
125 Web
126 Web
127 Web
128 Web
129 Web
130 Web
131 Web
132 Web
133 Web
134 Web
135 Web
136 Web
137 Terminal edge
138 Connecting element
139 Connecting web
140 Thickness
141 Height
142 Wall thickness
143 Peripheral web
144 Peripheral web
145 Checking projection
147 Guide web
148 Guide web
149 Stop web
150 Stop web
155 Web
156 Web
157 Control block
158 Arrow
159 Oblique ramp
160 Control surface
161 Oblique ramp
163 Stop web
164 Height
165 Internal contour
166 Positioning element
**167*a*** Side wall
**167*b*** Side wall
168 Oblong slot
169 Slim face
**170*a*** Housing part
**170*b*** Housing part
171 Switch contact
172 End face
173 End face
174 Bearing bore
**175*a*** Switch contact
**175*b*** Switch contact
176 Contact web
177 Retaining projection
178 Housing compartment
179 Terminal face
180 Flange
181 Support arm
182 Terminal face
183 Recess
184 Recess
185 Cover
186 Spring element
190 Web
191 Web
192 Web
193 Web
194 Web
196 Swivel plate
198 Magnifying glass
199 Axis
200 Pivot-bearing region
201 Guide mechanism
202 Lateral guide web
203 Lateral guide web
204 Lateral guide web
205 Oblong slot
206 Transverse web
207 Compartment web
208 Guide surface
209 Slide
210 Locking web
211 Transverse web
212 Lock recess
214 Guide projection
215 Locking projection
216 Guide surface
217 Housing compartment
218 Mid-axis
219 Distance
220 Web
221 Guide rail
222 Guide groove

223 Oblong slot
224 Housing segment
225 Lighting means housing
226 Axis
227 Connecting line
228 Locking projection
229 Lock recess
230 Gripping depression

What is claimed is:

1. Implement for a pocket tool displaceable out of a stowed position inside a housing area of a housing body into an operating position outside of said housing area of said housing body, comprising:

(a) a housing case with oppositely lying side walls having
  (1) side faces extending substantially parallel and spaced apart from each other,
  (2) slim faces extending between said side walls,
(b) at least one lighting means arranged on a first slim face of said housing case and emitting a beam outwardly from said housing body and
(c) at least one opposite contact and
(d) a strip-shaped retaining arm which is displaceable between an initial position and an operating position having
  (1) a first terminal end,
  (2) a second terminal end, and
  (3) a guide mechanism for guiding and moving an electrically conductive switch contact which is connected to said lighting means and said switch contact sits apart from said opposite contact when said retaining arm is in said initial position and sits against and is electrically connected to said opposite contact when said retaining arm is in said operating position; and
(e) a switch mechanism for said lighting means having
  (1) an operating element provided on a second, freely accessible slim face of said housing case remote from said housing body and connected to the strip-shaped retaining arm by means of shaft.

2. The implement as in claim 1, wherein said angle of said beam has an adjustable angle to a plane oriented perpendicular to said longitudinal axis of said pocket tool.

3. The implement as in claim 1, wherein said lighting means is an LED or RED.

4. The implement as in claim 1, wherein said angle of said beam is between approximately 0 and approximately 170°.

5. The implement as in claim 4, wherein said angle of said beam is between approximately 30° and approximately 140°.

6. The implement as in claim 4, wherein said angle of said beam is approximately 50°.

7. The implement as in claim 1, wherein at least one energy storage device, is arranged in said housing case.

8. The implement as in claim 7, wherein said energy storage device is a battery or a solar cell.

9. The implement as in claim 1, wherein at least one power consumer in addition to said lighting means, is arranged in said housing case.

10. The implement as in claim 9, wherein said power consumer is a display unit.

11. The implement as in claim 10, wherein said display unit is an LCD display.

12. The implement as in claim 9, wherein said power consumer is an input unit.

13. The implement as in claim 9, wherein said power consumer is a key pad, a tip switch, a pressure sensor, or a touch screen.

14. The implement as in claim 9, wherein said power consumer is a microprocessor.

15. The implement as in claim 1, wherein an electronic circuit for said lighting means is arranged in said housing case.

16. The implement as in claim 14, wherein said power consumer is an electronic transmitter and/or receiver module.

17. The implement as in claim 15, wherein said microprocessor has a data memory.

18. The implement as in claim 1, wherein:

said housing body includes a control block projecting out beyond the internal contour of said housing case; and said first slim face has a positioning element moveable via said control block between an initial position and an operating position.

19. The implement as in claim 1, wherein:

said lighting means has a first terminal contact and a second terminal contact;

said positioning element is in the form of an electrically conductive switch contact electrically connected to said first terminal contact of said lighting mean;

said switch contact is electrically isolated from a first terminal face of an energy storage device in its initial position and is electrically connected to a first terminal face of the energy storage device in it operating position; and said second terminal contact of said lighting means is permanently electrically connected to a second terminal face of the energy storage device.

20. The implement as in claim 19, wherein:

said lighting means has a first terminal contact and a second terminal contact;

said second terminal contact of said lighting means is permanently electrically connected to a second terminal face of an energy storage device said positioning element is in the form of a flexible arm coupled to said first terminal contact of said lighting means; and when said positioning element is in its initial position, said first terminal contact of said lighting means is electrically isolated from a first terminal face of an energy storage device and, when said positioning element is in its operating position, said first terminal contact of said lighting means is electrically connected to the first terminal face of the energy storage device.

21. A pocket tool as in claim 1, wherein:

said retaining arm has two guide webs spaced apart from each other;

a switch contact is guided between said guide webs and coupled to said retaining arm; and when said retaining arm is in said initial position, said switch contact is positioned apart from an opposite contact, and when said retaining arm is in said operating position said retaining arm sits against and is electrically connected to said opposite contact.

22. The implement as in claim 1, wherein said opposite contact is an energy storage device.

23. The implement as in claim 1, wherein:

said retaining arm:

has a first terminal end and a second terminal end;

is longitudinally slideable by means of a first bearing surface provided in the region of said first terminal end on a switch block; and is pivotable relative to said bearing surface; and a second bearing surface is provided in the region of said second terminal end lying of a guide block to guide said retaining arm in its longitudinal direction.

24. The implement as in claim 1, wherein said implement can be locked in its stowed position and/or operating position by means of a catch or snap-fit mechanism provided between it and said housing body.

25. The implement as in claim 1, further comprising a lighting means housing pivotably mounted about an axis oriented perpendicular to said side faces and in which said at least one lighting means is accommodated.

26. The implement as in claim 1, wherein at least one other implement is disposed on a slim face of said pocket tool opposite said first implement, said at least one other implement being designed to be displaced relative to said housing body out of said stowed position inside said housing body into said operating position outside said housing body.

27. A pocket tool as in claim 1, further comprising at least one of an electronic circuit for said lighting means and/or at least one energy storage device and/or at least one power consumer and/or a switch mechanism electrically connected to said lighting means by line connections and arranged separately from said first implement and integrated in said housing body externally thereto or disposed in a cover plate attached to said side wall or in said side wall.

28. The implement as in claim 1, wherein:

said housing body has a base plate and a cover plate lying opposite each other and coupled to each other;

said base plate and said cover plate form parallel mutually facing internal side faces in at least certain regions; and housing areas, separated from one another in at least certain regions by means of webs, extend between and in a plane parallel to said base plate and said cover plate for said displaceable first implement and at least one other removable implement.

29. The implement as in claim 28, wherein:

several webs are distributed across said internal side face of at least one of said base and said cover plate;

said webs at least partially separated from one another and project out from said side face of said at least one of said base plate and said cover plate towards the other of said base plate and said cover plate;

said webs having a height extending across at least a part of a total internal height between said side faces of said base plate and said cover plate;

said webs bound at least certain regions of said respective housing area when said cover plate is coupled to said base plate.

30. The implement as in claim 28, wherein several webs:

are distributed across the internal side face of at least one of said base plate and said cover plate;

are formed on said side face at least partially separated from one another;

project out from said at least one of said base plate and said cover plate towards the other of said base plate and said cover plate;

have a height extending across at least a part of a total internal height between said internal side faces of said base plate and said cover plate; and bound at least certain regions of said respective housing area when said cover place is placed on said base plate.

31. The implement as in claim 30, wherein said webs:

have a height corresponding to approximately a total internal height between said internal side faces of said base plate and said cover plate;

lie adjacent to one another when said cover plate is placed on said base plate;

abut at terminal edges facing said internal side faces of said base plate and said cover plate with said internal side faces of said base plate and said cover plate; and are joined by means of a joining element.

32. The implement as in claim 28, wherein:

said webs are respectively arranged opposite one another on said base plate and said cover plate; and when said cover plate is placed on said base plate, said webs extend towards one another and together form a continuous web from said base plate to said cover plate.

33. The implement as in claim 28, wherein said housing case of said implement is pivotably mounted on one of said base plate or said cover plate about an axis extending perpendicular to said internal side faces, or is slideable relative to said base plate and said cover plate in a plane extending parallel to said internal side faces.

34. The implement as in claim 33, wherein:

said housing case of said implement is designed in the shape of a segment of a circle and is provided with a bearing bore disposed concentrically with said axis perpendicular to said internal side faces; and said lighting means is disposed on a slim face remote from said housing body and radially offset from said bearing bore.

35. The implement as in claim 1, wherein said guide mechanism is arranged on a side face of the retaining arm and comprises guide webs at a distance from one another, said switch contact being guided between said guide webs.

36. The implement as in claim 1, wherein:

(a) the retaining arm comprising (1) a first bearing surface within the region of its first terminal end; and (2) a second bearing surface within the region of its second terminal end; and (b) the housing case comprising:

(1) a switch block assigned to the first terminal end of the retaining arm; and (2) a guide block assigned to the second terminal end of the retaining arm whereby the retaining arm is guided by its bearing surfaces at the switch and guide blocks and is slideable in its longitudinal direction on the switch and guide blocks.

37. The implement as in claim 26, wherein said pocket tool can be supported on a working surface by means of a support surface of said other implement when moved out of said housing body.

38. A switch connecting mechanism for a switch contact in an implement of a pocket tool, said switch connecting mechanism comprising a retaining arm extending in a longitudinal direction and having a first terminal end and a second terminal end lying opposite said first terminal end, wherein:

said retaining arm:

is longitudinally slideable in a region of said first terminal end on a switch block extending parallel to said longitudinal direction;

is pivotably seated relative to a first bearing surface;

sits on a guide block in a region of said second terminal end so as to be longitudinally guided; and has a bending-resistant rocker arm section extending across less than half of the length of said retaining arm perpendicular to said first bearing surface and a flexible arm section extending along the remainder of the length of the retaining arm; and said flexible arm section of said retaining arm tapers towards its oppositely lying terminal end; and an opposite contact co-operates with said switch contact on said second terminal end of said flexible arm section in a displacement region between a deformed initial position of said flexible arm and an extended operating position of said flexible arm.

39. A switch connecting mechanism as in claim 38, wherein:

said switch connecting mechanism further includes an operating element; and said retaining arm or said operating element can be locked in said initial position and/or said operating position.

40. A switch connecting mechanism as in claim 39, wherein:

said switch connecting mechanism is provided in an implement as in claim 1; and said implement is provided with a catch recess on said retaining arm or said operating element for locating with said catch nose.

41. A switch connecting mechanism as in claim 38, further comprising an operating element, wherein:

said switch connecting mechanism is provided in an implement as in claim 1;

said bending-resistant rocker arm section incorporates said operating element projecting out from said freely accessible other slim face of said housing case; and said operating element extends in said longitudinal direction of said retaining arm.

42. A switch connecting mechanism as in claim 38, further comprising as operating element, wherein:

said switch connecting mechanism is provided in an implement as in claim 1;

said operating element is designed to be displaceable against said spring action of said retaining arm in said region of said resiliently elastic flexible arm section in the direction of an axis extending perpendicular to said longitudinal extension of said retaining arm and/or parallel to said longitudinal extension of said retaining arm.

43. A switch connecting mechanism as in claim 38, wherein:

said retaining arm is provided with a guide mechanism against which said switch contact is mounted so that said retaining arm can be guided; and said first switch contact is coupled with said retaining arm in displacement.

44. A switch connecting mechanism as in claim 43, wherein said guide mechanism is arranged on a side face of said retaining arm and has at least two spaced apart guide webs between which said switch contact is guided.

45. A switch connecting mechanism as in claim 44, wherein said switch contact has several bends in its longitudinal extension, and is guided on said switch block and on at least one of said guide webs when said retaining arm is in said operating position.

46. A switch connecting mechanism as in claim 38, wherein said electrically conductive switch contact is in the form of a resiliently elastic leaf spring electrically connected to a terminal contact of a power consumer, or is in the form of a terminal wire of the power consumer.

47. A switch connecting mechanism as in claim 38, wherein a free end of said switch contact extends from said second terminal end of said retaining arm.

48. A pocket tool comprising:

a housing body, and at least one implement displaceable out of a stowed position inside said housing body into an operating position outside said housing body;

at least one lighting means;

an opposite contact; and an operating button;

wherein:

said at least one implement has a housing case with two mutually opposite side faces and a slim face extending therebetween;

said lighting means and said operating button are arranged on said slim face of said housing case;

said operating button is connected by means of a shaft to a retaining arm;

said retaining arm is displaceable between a non-operating position and an operating position, and has spaced apart guide webs on one of its side faces between which a terminal wire of said lighting means is guided; and said terminal wire of said lighting means sits apart from said opposite contact when said retaining arm is in said non-operating position and sits against and is electrically connected to said opposite contact when said retaining arm is in said operating position.

49. A pocket tool comprising:

(a) a housing body having two mutually opposite side faces defining at least one housing area between said side faces;

(b) at least an implement displaceable out of a stowed position inside said housing area into an operating position outside of said housing area, wherein said implement has:

(1) a housing case with oppositely lying side wails having side faces extending substantially parallel and spaced apart from each other, and slim faces extending between said side walls; and (2) at least one lighting means arranged on a first slim face of said housing case and emitting a beam outwardly from said housing body and at an angle to a plane oriented perpendicular to said longitudinal axis of said pocket tool; and (3) a stop nose arranged on a second slim face of said housing case lying opposite said lighting means; said stop nose being configured to be supported on a bearing surface in said housing body when said implement is in said stowed position.

50. A pocket tool comprising:

(a) a housing body having (1) two mutually opposite side faces defining at least a housing area between said side faces;

(b) at least a first implement displaceable out of a stowed position inside said housing area into an operating position outside of said housing area, wherein said implement has:

(1) a housing case with oppositely lying side walls having side faces extending substantially parallel and spaced apart from each other, and slim faces extending between said side walls; and (2) at least one lighting means arranged on a first slim face of said housing case and emitting a beam outwardly from said housing body and at an angle to a plane oriented perpendicular to said longitudinal axis of said pocket tool; and (c) a control block arranged on the housing body projecting out beyond the internal contour of said housing case; and (d) a positioning element arranged on said implement moveable via said control block between and initial position and an operating position.

51. A pocket tool comprising:

(a) a housing body having two mutually opposite side faces defining at least a first and second housing area between said side faces;

(b) a first implement displaceable out of a stowed position inside said first housing area into an operating position outside of said first housing area, wherein said first implement has:

(1) a housing case with opposite lying side walls having side faces extending substantially parallel and spaced apart from each other, and slim faces extending between said side walls; and (2) at least one lighting means arranged on a first slim face of said housing case and emitting a beam outwardly from said housing body and at an angle to a place oriented perpendicular to said longitudinal axis of said pocket tool; and (c) a second implement disposed on a slim face of said pocket tool opposite said first implement, wherein:

(1) said second implement being designed to be displaced relative to said second housing area out of said stowed position inside said second housing area into said operating position outside said housing body, and (2) said second implement has a support surface and said pocket tool can be supported on a working surface by means of said support surface of said implement when moved out of said housing body.

52. A pocket tool comprising:

(a) a housing body having (1) two oppositely lying side faces defining at least one housing area between said side faces; and (b) an implement displaceable between a first position inside said housing area and a second position at least partially outside said housing area, which being disposed between said side faces, said implement having (1) a housing case with two oppositely lying side walls, and (2) a slim face extending between said housing case, (3) at least one lighting means arranged on said slim face of said housing case, (4) at least one opposite contact, (5) a strip-shaped retaining arm which is displaceable between an initial position and an operating position, and said retaining arm is provided with a guide mechanism for guiding and moving an electrically conductive switch contact which is connected to said lighting means and said switch contact sits apart from said opposite contact when said retaining arm is in said initial position and sits against and is electrically connected to said opposite contact when said retaining arm is in said operating position, and (6) an operating element arranged on said slim face of said housing case and said operating element is connected by means of a shaft to said strip-shaped retaining arm.

53. A pocket tool comprising:

(a) a housing body having two mutually opposite side walls defining at least one housing area between said side walls;

(b) cover plates arranged on said side walls;

(c) an implement displaceable out of a stowed position inside said first housing area into an operating position outside of said housing area, wherein said implement has:

(1) a housing case with oppositely lying side walls having side faces extending substantially parallel and spaced apart from each other, and a slim face extending between said side walls; and (2) at least one lighting means arranged on the slim face of said housing case and emitting a beam outwardly from said housing body and at an angle to a plane oriented perpendicular to said longitudinal axis of said pocket tool; and (d) an electronic circuit for said lighting means;

(e) at least one energy storage device;

(f) a switch mechanism, said energy storage and said switch mechanism are electrically connected to said lighting means by line connections and arranged separately from said implement and integrated in said housing body or disposed in one of said cover plates.

* * * * *